US008695566B2

(12) United States Patent
Kawaguchi et al.

(10) Patent No.: US 8,695,566 B2
(45) Date of Patent: Apr. 15, 2014

(54) ENGINE CONTROL APPARATUS

(75) Inventors: Tadashi Kawaguchi, Hiratsuka (JP); Jun Morinaga, Hiratsuka (JP); Hiroaki Inoue, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 1035 days.

(21) Appl. No.: 12/733,749

(22) PCT Filed: Sep. 11, 2008

(86) PCT No.: PCT/JP2008/066434

§ 371 (c)(1),
(2), (4) Date: Mar. 18, 2010

(87) PCT Pub. No.: WO2009/038017

PCT Pub. Date: Mar. 26, 2009

(65) Prior Publication Data

US 2011/0167811 A1 Jul. 14, 2011

(30) Foreign Application Priority Data

Sep. 19, 2007 (JP) ..... 2007-243100

(51) Int. Cl.

| | |
|---|---|
| ***F02D 29/04*** | (2006.01) |
| ***F02D 29/06*** | (2006.01) |
| ***F02D 41/04*** | (2006.01) |
| ***F02D 41/32*** | (2006.01) |

(52) U.S. Cl.

USPC ..... 123/350; 60/702

(58) Field of Classification Search

USPC ..... 701/50; 123/349, 350, 351, 364, 365, 123/367, 198 C; 60/701, 702; 322/14, 15, 322/16, 40; 903/905, 906

See application file for complete search history.

(56) References Cited

U.S. PATENT DOCUMENTS 4,332,517 A * 6/1982 Igarashi et al. ..... 701/50
6,020,651 A * 2/2000 Nakamura et al. ..... 123/496

(Continued)

FOREIGN PATENT DOCUMENTS

CN 1993541 A 7/2007
JP 11-002144 A 1/1999

(Continued)

OTHER PUBLICATIONS

Office Action dated Jun. 11, 2012, issued for the corresponding Chinese Patent Application No. 200880116541.3.

International Search Report and Written Opinion dated Nov. 25, 2008, issued in International Application No. PCT/JP2008/066434.

*Primary Examiner* — Stephen K Cronin
*Assistant Examiner* — Arnold Castro
(74) *Attorney, Agent, or Firm* — Edwards Wildman Palmer LLP

(57) ABSTRACT

An engine control apparatus includes a hydraulic pump driven by an engine, a hydraulic actuator to which pressure oil discharged form the hydraulic pump is supplied, an operation lever configured to operate the hydraulic actuators, a detection means detecting operation amounts of operation lever means, an target flow rate calculation unit (50) calculating an target flow rate of the hydraulic pump based on the operation amount of the operation lever, a first target speed calculation unit (61) calculating a first target speed of the engine according to the target flow rate, a pump output limit value calculation unit (500) limiting the maximum target speed of the engine in an relief operation according to a load pressure of the hydraulic pump, a fourth engine target speed calculation unit (63).

8 Claims, 18 Drawing Sheets

(56) References Cited

U.S. PATENT DOCUMENTS

| | | | | |
|---|---|---|---|---|
| 6,820,356 | B2 * | 11/2004 | Naruse et al. | 701/50 |
| 7,543,447 | B2 | 6/2009 | Itoga et al. | |
| 7,565,801 | B2 * | 7/2009 | Tozawa et al. | 60/414 |
| 7,962,768 | B2 * | 6/2011 | Grill et al. | 713/300 |
| 2007/0204605 | A1 | 9/2007 | Itoga et al. | |
| 2009/0320461 | A1 * | 12/2009 | Morinaga et al. | 60/431 |
| 2010/0094515 | A1 * | 4/2010 | Shirao et al. | 701/50 |

FOREIGN PATENT DOCUMENTS

| | | | |
|---|---|---|---|
| JP | 11-107322 | | 4/1999 |
| JP | 2001-323827 | A | 11/2001 |
| JP | 2003-028071 | A | 1/2003 |
| JP | 2004-301312 | | 10/2004 |
| JP | 2006-169974 | A | 6/2006 |
| JP | 2007-177719 | | 7/2007 |
| JP | 2007-218111 | | 8/2007 |

* cited by examiner

ENGINE CONTROL APPARATUS

TECHNICAL FIELD

The present invention relates to an engine control apparatus configured to drive a hydraulic pump through an engine.

BACKGROUND ART

In the related art, diesel engines are installed on construction machines including hydraulic shovels, bulldozers, dump trucks, and wheel loaders.

FIG. 21 illustrates a configuration of a conventional construction machine 100. Referring to FIG. 21, the construction machine 100 uses an engine 2, which is a diesel engine, as a driving source to drive a hydraulic pump 3. A capacity variable type hydraulic pump is used as the hydraulic pump 3, and a tilt angle of an inclined plate 3*a* of the hydraulic pump 3 is varied to change a capacity q (cc/rev). Pressure oil discharged at a discharge pressure PRP and a flow rate Q (cc/min) from the hydraulic pump 3 are supplied to hydraulic actuators 31, 32, 33, 34, 35, and 36 including a boom cylinder 31 through operation valves 21, 22, 23, 24, 25, and 26. The operation valves 21, 22, 23, 24, 25, and 26 are operated by operating operation levers and 42. Pressure oil is supplied to each of the hydraulic actuators 31, 32, 33, 34, 35, and 36 to be driven, and then, a work device including a boom, an arm, and a bucket connected to the hydraulic actuators 31, 32, 33, 34, 35, and 36, a lower travel body, and an upper swing body are operated. While the construction machine 100 is operated, loads applied to the work device, the lower travel body, and the upper swing body is continually varied according to the quality of earth to be excavated, the slope of travel path. Accordingly, a load of the hydraulic device (the hydraulic pump 3), that is, a load applied to the engine 2 is varied.

An output P (horsepower; kw) of the engine 2 is controlled by adjusting a fuel amount injected into the cylinder. The adjusting of the fuel amount is performed by controlling a governor 4 provided to a fuel injection pump of the engine 1. An all speed control type governor is generally used as the governor 4. An engine speed n and a fuel injection amount (torque T) are adjusted according to a load to maintain a target engine speed set with a fuel dial. That is, the governor 4 increases or decreases the fuel injection amount such that the target speed is equal to the engine speed.

FIG. 22 is a torque graph of the engine 2 with a horizontal axis being the engine speed n (rpm; rev/min) and a vertical axis being the torque T (N.m). Referring to FIG. 22, a region defined as a maximum torque line R denotes the performance of the engine 2. The governor 4 controls the engine 2 to prevent the torque T from reaching an exhaust gas limit over the maximum torque line R, and prevent the engine speed n from reaching over rotation over a high idle speed nH. The output (horsepower) P of the engine 2 is maximal at a rated point V on the maximum torque line R. Along an iso horsepower curve J, horsepower absorbed at the hydraulic pump 3 is disposed.

When the maximum target speed is set with the fuel dial, the governor 4 adjusts speed on a maximum speed regulation line Fe connecting the rated point V to a high idle point nH.

As the load of the hydraulic pump 3 is increased, a matching point where the output of the engine 2 and a pump absorption horsepower are in equilibrium moves to the rated point V on the maximum speed regulation line Fe. When the matching point moves to the rated point V, the engine speed n is slowly decreased. The engine speed n is a rated speed at the rated point V.

As such, in the state the engine speed n is fixed at a substantially constant high speed, when a work is performed, fuel consumption rate is increased (deteriorate), and pump efficiency is decreased. The fuel consumption rate (hereinafter, fuel efficiency) means a fuel consumption amount per hour and output of 1 kw, which is an index indicating the efficiency the engine 2. In addition, the pump efficiency is an efficiency of the hydraulic pump 3 defined as volume efficiency and torque efficiency.

Referring to FIG. 22, an iso fuel efficiency curve M has a trough M1 where the fuel efficiency is minimal. The fuel efficiency is increased from the minimum fuel efficiency point M1 to the outside.

As illustrated in FIG. 22, the regulation line Fe corresponds to a region where the fuel efficiency is relatively large on the iso fuel efficiency curve M. Thus, according to a conventional control method, the fuel efficiency and the engine efficiency are poor.

In the case of the capacity variable type hydraulic pump 3, when the discharge pressure PRP is constant, as the pump capacity q (the tilt angle of the inclined plate) is increased, the volume efficiency and the torque efficiency are increased, so that the pump efficiency is high.

Referring to Formula 1, in the state where the flow rate Q of pressure oil discharged from the hydraulic pump 3 is constant, when the speed n of the engine 2 is decreased, the pump capacity q can be increased. Thus, when the speed of the engine 2 is decreased, the pump efficiency can be increased.

$$Q=n\cdot q \tag{1}$$

Thus, to increase the efficiency of the hydraulic pump 3, the engine 2 is operated in a low speed region where the speed n of the engine 2 is small.

However, as illustrated in FIG. 22, the regulation line Fe corresponds to the high speed region of the engine 2. Thus, according to a conventional control method, the pump efficiency is low.

In addition, when the engine 2 is operated on the regulation line Fe, the engine speed is decreased at a high load state. Thus, engine stop may occur.

A control method of substantially fixing an engine speed regardless of the load is described above. On the other hand, a control method in which an engine speed is varied according to a lever operation amount and a load is disclosed in Patent Document 1.

In Patent Document 1, as illustrated in FIG. 22, an target engine driving line L0 passing through a fuel efficiency minimum point M1 is set.

In addition, a necessary speed of the hydraulic pump 3 is calculated based on operation amounts of the operation levers 41, 42, 43, and 44, and a first engine necessary speed corresponding to the necessary speed of the hydraulic pump 3 is calculated. Furthermore, an engine necessary horsepower is calculated based on operation amounts of the operation levers 41, 42, 43, and 44, and a second engine necessary speed corresponding to the engine necessary horsepower is calculated. In this case, the second engine necessary speed is calculated as the engine speed on the target engine driving line L0 of FIG. 22. The engine speed and the engine torque are controlled to obtain the greater one of the first and second engine necessary speeds.

As illustrated in FIG. 22, when the speed of the engine 2 is controlled along the target engine driving line L0, fuel efficiency, engine efficiency, and pump efficiency are improved. This is because, even when an identical horsepower is output to obtain an identical required flow rate, matching with a point pt2 on the iso horsepower line J and the target engine driving line L0 is adapted for a move from a high speed and a lower torque to a low speed and a high torque for increasing the pump capacity q and a driving to the fuel efficiency minimum point M1 on the iso fuel efficiency M, relative to matching with a point pt1 on the regulation line Fe. In addition, since the engine 2 is driven in a low rotation region, noises, engine friction, and pump unload loss are reduced.

In addition, in the construction machine field, as construction machines using a hybrid manner in which the driving force of an engine is assisted by a generator motor are developed, many patents have been applied.

For example, in Patent Document 2, as illustrated in FIG. 22, the engine 2 is controlled along a regulation line Fe0 corresponding to a set speed set with the fuel dial. An target speed nr corresponding to a point A where the regulation line Fe0 crosses the target engine driving line L0 is determined. When a deviation between the engine target speed nr and the current engine speed n is plus, a generator motor performs electric motor action to assist the driving force of the engine 2 using torque generated from the generator motor. When the deviation is minus, the generator motor performs generation action to generate electricity to store power in a storage battery.

[Patent Document 1] Japanese Patent Application Laid-Open (JP-A) No. 11-2144

[Patent Document 2] Japanese Patent Application Laid-Open (JP-A) No. 2003-28071

DISCLOSURE OF INVENTION

Problem To Be Solved by the Invention

In Patent Document 1, the engine target speed is determined according to the load of the hydraulic pump 3. In addition, as illustrated in FIG. 22, as the hydraulic pump 3 is close to the high load, a matching point disposed at the high load side on the target engine driving line L0 is moved from B to A. In this case, when the work device is in a high load state, for example, in contact with a hard rock, the pump pressure is quickly increased, and a relief valve is operated, so as to cause an additional energy loss. Thus, in the related art, an inclined plate of a hydraulic pump is controlled to vary a pump capacity, thereby decreasing a relief flow rate.

However, when the pump capacity is decreased to reduce the relief flow rate, the pump efficiency is decreased. Furthermore, in this case, since an engine speed is greater than an optimal engine speed, the engine efficiency is degraded.

To address these limitations, the invention provides an engine control apparatus capable of improving pump efficiency and engine efficiency at a high load state such as a relief operation.

Means for Solving Problem

According to an aspect of the present invention, an engine control apparatus includes: a hydraulic pump driven by an engine; a hydraulic actuator to which pressure oil discharged form the hydraulic pump is supplied; an operation unit configured to operate the hydraulic actuator; a first target speed set unit configured to set a first target speed of the engine; a second target speed calculation unit configured to calculate a second target speed limiting a maximum target speed of the engine according to increase of a load pressure of the hydraulic pump; and a speed control unit configured to control an engine speed such that the engine speed is equal to the lower one of the first target speed and the second target speed.

Advantageously, in the engine control apparatus, the first target speed set unit calculates the first target speed of the engine according to an operation amount of the operation unit.

Advantageously, the engine control apparatus further includes: a horsepower limit value calculation unit configured to calculate a pump horsepower limit value such that absorbable horsepower of the hydraulic pump is decreased according to the increase of the load pressure of the hydraulic pump. The second target speed calculation unit calculates the second target speed to limit the maximum target speed of the engine according to the horsepower limit value of the hydraulic pump calculated by the horsepower limit value calculation unit.

Advantageously, the engine control apparatus, further includes: a horsepower limit value calculation unit configured to calculate a pump horsepower limit value such that absorbable horsepower of the hydraulic pump is decreased when the load pressure of the hydraulic pump is greater than a value less than a value preset with respect to a relief pressure. The second target speed calculation unit calculates the second target speed to limit the maximum target speed of the engine according to the horsepower limit value of the hydraulic pump calculated by the horsepower limit value calculation unit.

Advantageously, the engine control apparatus, further includes: a maximum absorption torque control unit configured to control an absorbable maximum torque of the hydraulic pump according to the horsepower limit value of the hydraulic pump calculated by the horsepower limit value calculation unit.

Advantageously, the engine control apparatus, further includes: a generator motor connected to an output shaft of the engine; a storage battery configured to store electric power the generator motor generates, and to supply electric power to the generator motor; and a control unit. When the load pressure of the hydraulic pump is quickly switched from a high state to a low state, until a real speed of the engine is increased to be equal to or greater than a value preset with respect to the target speed, the control unit uses an engine torque assist action of the generator motor to control the engine speed to be equal to the target speed.

Advantageously, the engine control apparatus, further includes: a generator motor connected to an output shaft of the engine; a storage battery configured to store electric power the generator motor generates, and to supply electric power to the generator motor; and a control unit. By increase of the second target speed according to a case where the load pressure of the hydraulic pump is decreased from a high state to a low state, when a real speed of the engine is less than a preset value and the target speed, until the real speed is increased to be equal to or greater than a value less than the preset value and the target speed, the control unit uses an engine torque assist action of the generator motor to control the engine speed to be equal to the target speed.

Effect of the Invention

In an engine control apparatus according to the invention, a first target speed of the engine is set by a first speed set means, a second target speed calculation means calculates a second target speed limiting the maximum target speed of the engine according to the increase of a load pressure of a hydraulic pump, and a speed control means controls and decreases the engine speed such that the engine speed is equal to lower one of the first and second target speeds. Thus, pump efficiency and engine efficiency at a high load state such as a relief operation can be improved.

EXPLANATIONS OF LETTERS OR NUMERALS

Figure 1:
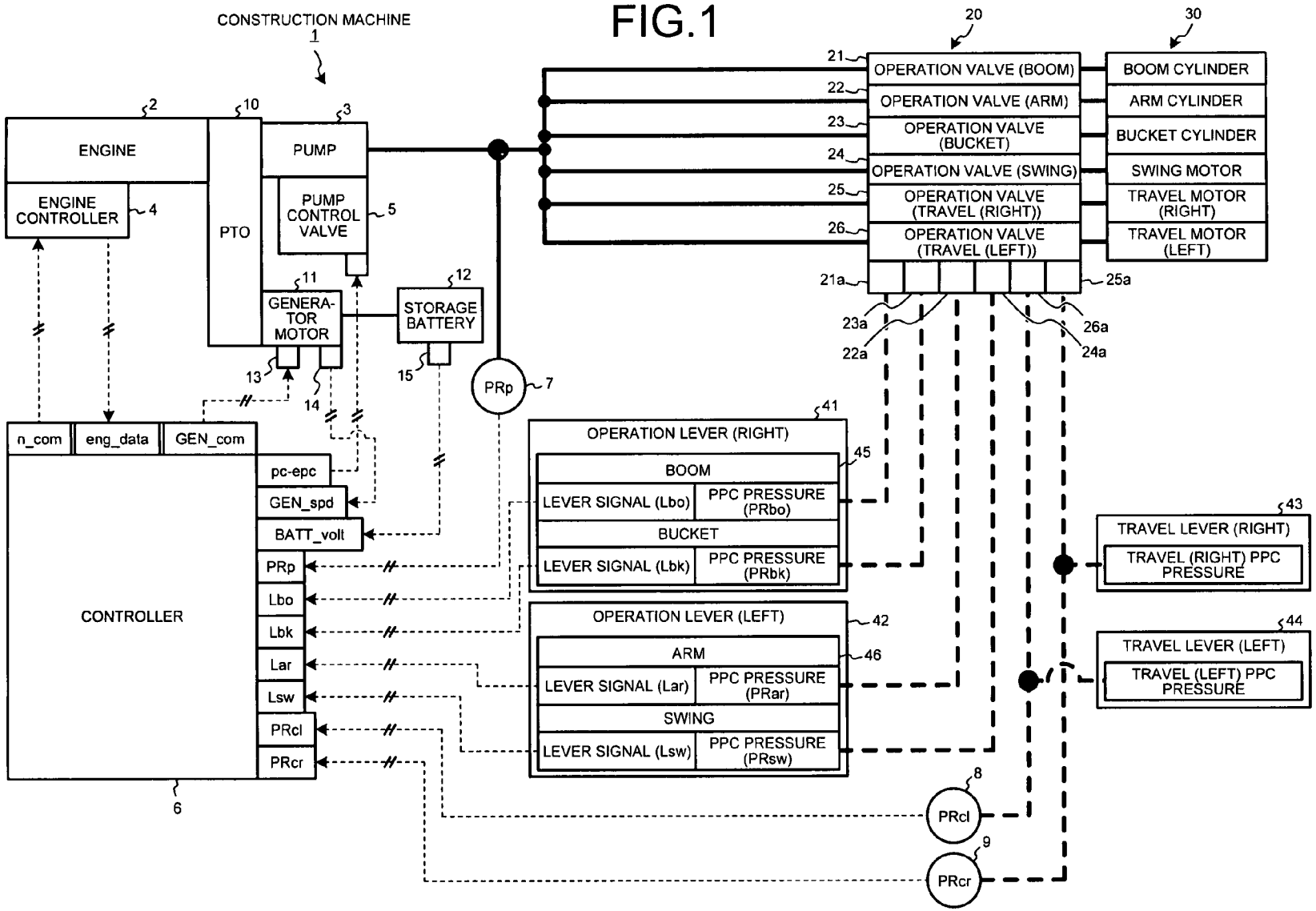
FIG. 1 is a block diagram illustrating a schematic configuration of a construction machine according to an embodiment of the invention.

1: construction machine
2: engine
3: hydraulic pump
4: engine controller
5: pump control valve
6: controller
7-9: hydraulic sensor
10: PTO shaft
11: generator motor
12: storage battery
31-36: hydraulic actuator
41, 42: operation lever
43, 44: travel lever
50: target flow rate calculation unit
61: first engine target speed calculation unit
63: fourth engine target speed calculation unit
64: maximum value selection unit
65, 501: minimum value selection unit
70: pump output limit calculation unit
101: filter
102: engine output calculation unit
103: target engine output calculation unit
104: engine target speed additional value calculation unit
105: addition unit
106: branch unit
500: pump output limit value calculation unit in relief operation

BEST MODE(S) FOR CARRYING OUT THE INVENTION

Hereinafter, an engine control apparatus according to an embodiment of the invention will now be described with reference to the accompanying drawings. In the embodiment, cases of controlling a diesel engine and a hydraulic pump installed on a construction machine such as a hydraulic shovel will be described.

FIG. 1 is a schematic view illustrating an entire structure of a construction machine 1 according to an embodiment of the invention. The construction machine 1 is a hydraulic shovel.

The construction machine 1 includes an upper swing body and a lower travel body that includes endless tracks on its left and right sides. To a machine body, a working device including a boom, an arm, and a bucket is coupled. A boom cylinder 31 is driven to operate the boom. An arm cylinder 32 is driven to operate the arm. A bucket cylinder 33 is driven to operate the bucket. Travel motors 36 and 35 are respectively driven to operate the left endless track and the right endless track. In addition, a swing motor 34 is driven to operate a swing machine. The upper swing body is rotated through a swing pinion and a swing circle.

An engine 2 is a diesel engine. The amount of fuel injected into the cylinder is adjusted to control an output (horsepower; kw) of the engine 2. This adjustment is performed by controlling a governor provided to a fuel injection pump of the engine 2. An engine controller 4 controls the engine as well as the governor.

A controller 6, with respect to the engine controller 4, outputs a rotation command value to set the number of rotations as an target number of rotations n_com. The engine controller 4 increases or decreases a fuel injection amount to obtain an target speed n_com at an target torque line L1. In addition, the engine controller 4 outputs an engine data eng_data, including an engine torque estimated from a speed of the engine 2 and a fuel injection amount of the engine 2, to a controller 6.

An output shaft of the engine 2 is connected to a driving shaft of a generator motor 11 through a PTO shaft 10. The generator motor 11 performs generation action and electric motor action. That is, the generator motor 11 operates as an electric motor (a motor), and functions as an electric generator. In addition, the generator motor 11 functions as a starter configured to start the engine 2. When a starter switch is turned on, the generator motor 11 performs electric motor action, and the output shaft of the engine 2 is rotated at a small speed (for example, a range from 400 rpm to 500 rpm), so as to start the engine 2.

The torque of the generator motor 11 is controlled by an inverter 13. The inverter 13, which will be descried later, controls the torque of the generator motor 11 according to a generator motor command value GEN_com output from the controller 6.

The inverter 13 is electrically connected to the storage battery 12 through a direct current power line. In addition, the controller 6 operates using a storage battery 12 as a power source.

The storage battery 12 is configured by a capacitor or a storage cell. When the generator motor 11 performs generation action, the storage battery 12 stores the electricity (charge). In addition, the storage battery 12 supplies the electricity stored in the storage battery 12 to the inverter 13. According to embodiments of the invention, storage cell such as a lithium ion storage battery, a nickel hydrogen storage battery, a lead storage battery or a capacitor storing electric power as static electricity is referred to as a storage battery.

The output shaft of the engine 2 is connected to a driving shaft of a hydraulic pump 3 through the PTO shaft 10. As the output shaft of the engine is rotated, the hydraulic pump 3 is driven. The hydraulic pump 3 is a variable capacity type hydraulic pump. In this case, as a tilt angle of an inclined plate is varied, a capacity q (cc/rev) is varied.

Pressure oil discharged at a discharge pressure $PR_p$ and a flow rate Q (cc/min) from the hydraulic pump 3 is supplied to a boom operation valve 21, an arm operation valve 22, a bucket operation valve 23, a swing operation valve 24, a right travel operation valve 25, and a left travel operation valve 26. The pump discharge pressure PRp is detected by the hydraulic sensor 7 and hydraulic detection signal is input to the controller 6.

The pressure oil output from the operation valve 21 is supplied to the boom cylinder 31. The pressure oil output from the operation valve 22 is supplied to the arm cylinder 32. The pressure oil output from the operation valve 23 is supplied to the bucket cylinder 33. The pressure oil output from the operation valve 24 is supplied to the swing motor 34. The pressure oil output from the operation valve 25 is supplied to the right travel motor 35. The pressure oil output from the operation valve 26 is supplied to the left travel motor 36. Accordingly, the boom cylinder 31, the arm cylinder 32, the bucket cylinder 33, the swing motor 34, the right travel motor 35, and the left travel motor 36 are driven to respectively operate the boom, the arm, the bucket, the upper swing body, and the right endless track and the left endless track of a lower travel body.

A work swing right operation lever 41 and a travel right operation lever 43 are installed on the right front side of a driver's seat of the construction machine 1. A work swing left operation lever 42 and a travel left operation lever 44 are installed on the left front side of the driver's seat of the construction machine 1.

The work swing right operation lever 41 is an operation lever configured to operate the boom and the bucket, which operates the boom and the bucket according to an operation direction and operates the boom and the bucket at a speed according to an operation amount.

A sensor 45 configured to detect an operation direction and an operation amount is installed at the operation lever 41. The sensor 45 inputs a lever signal, indicating an operation direction and an operation amount of the operation lever 41, to the controller 6. When the operation lever 41 is operated in a direction in which the boom is operated, a boom lever signal LbO, indicating a boom ascent operation amount and a boom descent operation amount according to a tilt direction and a tilt amount with respect to a neutral position of the operation lever 41, is input to the controller 6. In addition, when the operation lever 41 is operated in a direction in which the bucket is operated, a bucket lever signal Lbk, indicating a boom excavation operation amount and a boom dump operation amount according to a tilt direction and a tilt amount with respect to the neutral position of the w operation lever 41, is input to the controller 6.

When the operation lever 41 is operated in a direction in which the boom is operated, a pilot pressure (PPC pressure) PRbo according to a tilt amount of the operation lever 41 is added to one 21*a* of pilot ports of the boom operation valve 21 corresponding to a lever tilt direction (a boom ascent direction or a boom descent direction).

In a same manner, when the operation lever 41 is operated in a direction in which the bucket is operated, a pilot pressure (PPC pressure) PRbk according to a tilt amount of the operation lever 41 is added to one 23*a* of pilot ports of the bucket operation valve 23 corresponding to a lever tilt direction (a bucket excavation direction or a bucket dump direction).

The work swing left operation lever 42 is an operation lever configured to operate the arm and the upper swing body, which operates the arm and the upper swing body according to an operation direction and operates the arm and the upper swing body at a speed according to an operation amount.

A sensor 46 configured to detect an operation direction and an operation amount is installed at the operation lever 42. The sensor 46 inputs a lever signal, indicating an operation direction and an operation amount of the operation lever 42, to the controller 6. When the operation lever 42 is operated in a direction in which the arm is operated, an arm lever signal Lar indicating an arm excavation operation amount and an arm dump operation amount is input to the controller 6 according to a tilt direction and a tilt amount with respect to a neutral position of the operation lever 42. In addition, when the operation lever 42 is operated in a direction in which the upper swing body is operated, a swing lever signal Lsw, indicating a right swing operation amount and a left swing operation amount is input to the controller 6 according to a tilt direction and a tilt amount with respect to the neutral position of the operation lever 42.

When the operation lever 42 is operated in a direction in which the arm is operated, a pilot pressure (PPC pressure) PRar according to a tilt amount of the operation lever 42 is added to one 22*a* of pilot ports of the arm operation valve 22 corresponding to a lever tilt direction (an arm excavation direction or an arm dump direction).

In a same manner, when the operation lever 42 is operated in a direction in which the upper swing body is operated, a pilot pressure (PPC pressure) PRsw according to a tilt amount of the operation lever 42 is added to one 24*a* of pilot ports of the swing operation valve 24 corresponding to a lever tilt direction (a right swing direction or a left swing direction).

The travel right operation lever 43 and the travel left operation lever 44 are operation levers configured to respectively operate the right endless track and the left endless track, and operate the endless tracks according to operation directions and operate the endless tracks at speeds according to operation amounts.

A pilot pressure (PPC pressure) PRtr according to a tilt amount of the operation lever 43 is added to a pilot port 25*a* of the right travel operation valve 25.

The pilot pressure PRtr is detected by a hydraulic sensor 9, and a right travel pilot pressure PRcr indicating a right travel amount is input to the controller 6. In a same manner, a pilot pressure (PPC pressure) PRtl according to a tilt amount of the operation lever 44 is added to a pilot port 26*a* of the left travel operation valve 26. The pilot pressure PRtl is detected by a hydraulic sensor 8, and a left travel pilot pressure PRcl indicating a left travel amount is input to the controller 6.

The operation valves 21, 22, 23, 24, 25, and 26 are flow rate direction control valves which move spools in directions according to operation directions of the corresponding operation levers 41, 42, 43, and 44, and move the spools to open conduits by opening areas according to operation amounts of the operation levers 41, 42, 43, and 44.

A pump control valve 5 is operated by a control current pc-epc output from a controller 6, and is changed through a servo piston.

The pump control valve 5 controls a tilt angle of the inclined plate of the hydraulic pump 3 such that the product of the discharge pressure PRp (kg/cm$^2$) of the hydraulic pump 3 and the capacity q (cc/rev) of the hydraulic pump 3 is less than a pump absorption torque Tpcom corresponding to the control current pc_epc. This control is referred to as a PC control.

At the generator motor 11, a rotation sensor 14 configured to detect a current real speed GEN_spd (rpm) of the generator motor 11, that is, a real speed of the engine 2 is installed. A signal indicating the real speed GEN_spd detected by the rotation sensor 14 is input to the controller 6.

In addition, at the storage battery 12, a voltage sensor 15 configured to detect a voltage BATT_volt of the storage battery 12 is installed. A signal indicating the voltage BATT_volt detected by the voltage sensor 15 is input to the controller 6.

In addition, the controller 6 outputs the generator motor command value GEN_com to the inverter 13, so that the generator motor 11 performs generation action or electric motor action. When the controller 6 output the command value GEN_com to the inverter 13 to operate the generator motor 11 as a generator, a portion of an output torque generated at the engine 2 is transmitted to the driving shaft of the generator motor 11 through the output shaft of the engine so as to absorb the torque of the engine 2 and generate electricity. An alternating current power generated from the generator motor 11 is converted into a direct current power at the inverter 13, and then the direct current power is stored in the storage battery 12 through the direct current power line (charge).

When the controller 6 output the command value GEN_com to the inverter 13 to operate the generator motor 11 as an electric motor, the inverter 13 controls the generator motor 11 to function as an electric motor. That is, power is output from the storage battery 12 (discharge), and a direct current stored in the storage battery 12 is converted to an alternating current at the inverter 13, and the current is supplied to the generator motor 11 to rotate the driving shaft of the generator motor 11. Accordingly, the torque is generated from the generator motor 11, and the torque is transmitted to the output shaft of the engine through the driving shaft of the generator motor 11, and is added to the output torque of the engine 2(the output of the engine 2 is assisted). The added output torque is absorbed at the hydraulic pump 3.

A generation amount (absorption torque amount) and an electromotion amount (assist amount; a generated torque amount) of the generator motor 11 are varied according to contents of the generator motor command value GEN_com.

The controller 6 outputs a rotation command value to the engine controller 4 including the governor to increase or decrease a fuel injection amount so as to obtain an target speed according to a current load of the hydraulic pump 3, so that a speed n of the engine 2 and a torque T are adjusted.

Figure 2:
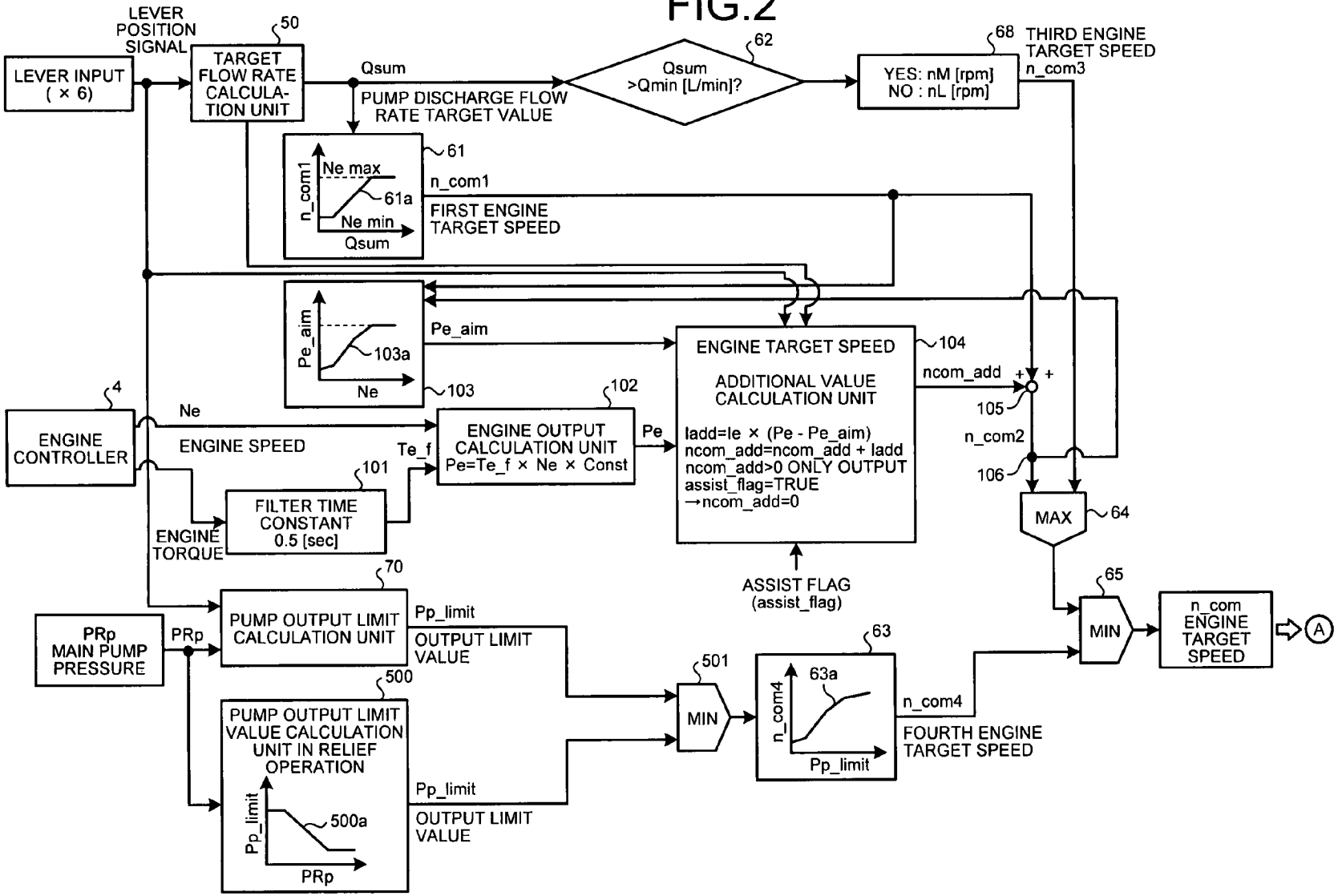
FIG. 2 is a first flow chart illustrating a control flow of a controller of FIG. 1.
Figure 3:
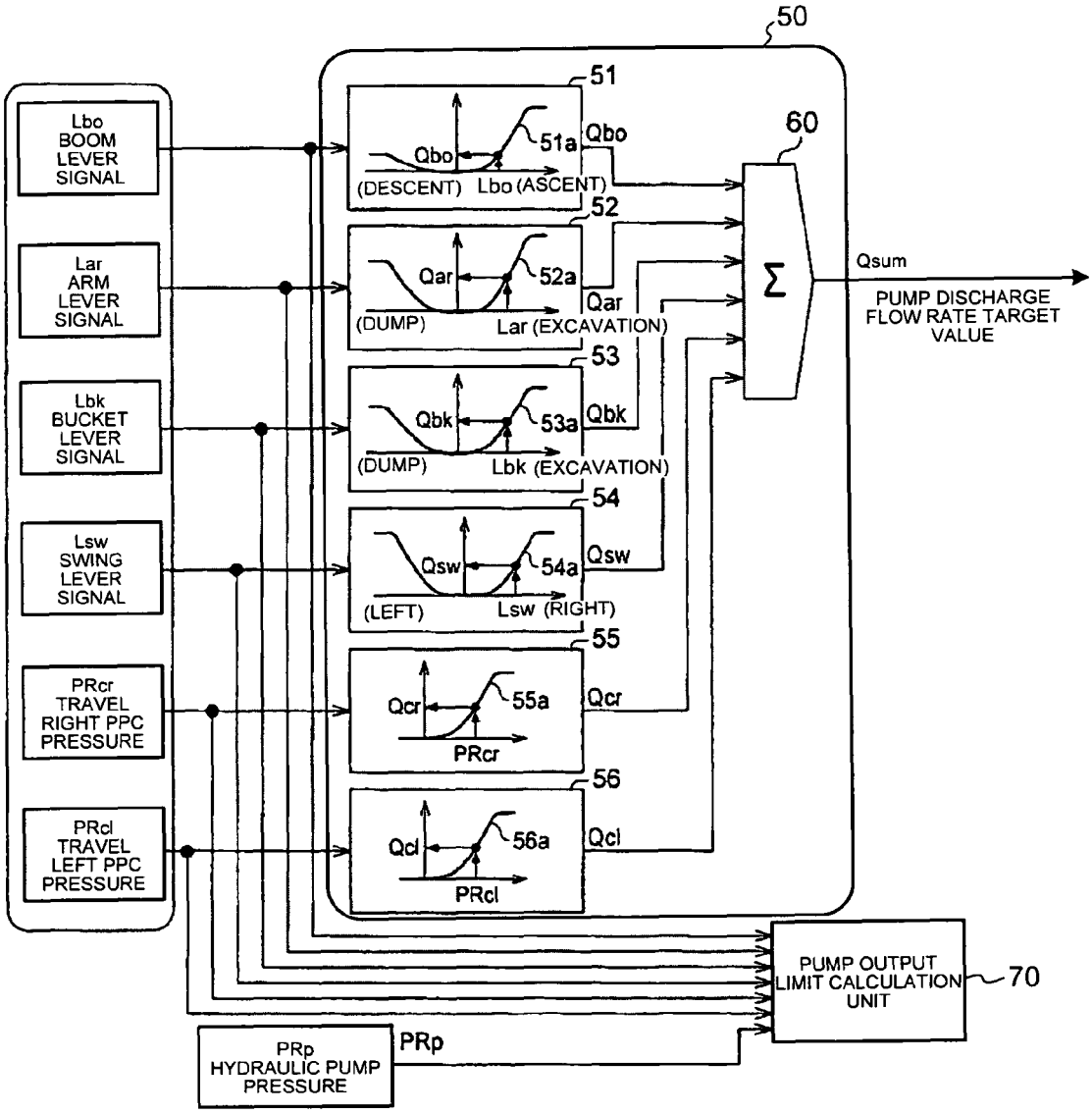
FIG. 3 is a flow chart illustrating a control flow of an target flow rate calculation unit illustrated in FIG. 2.
Figure 4:
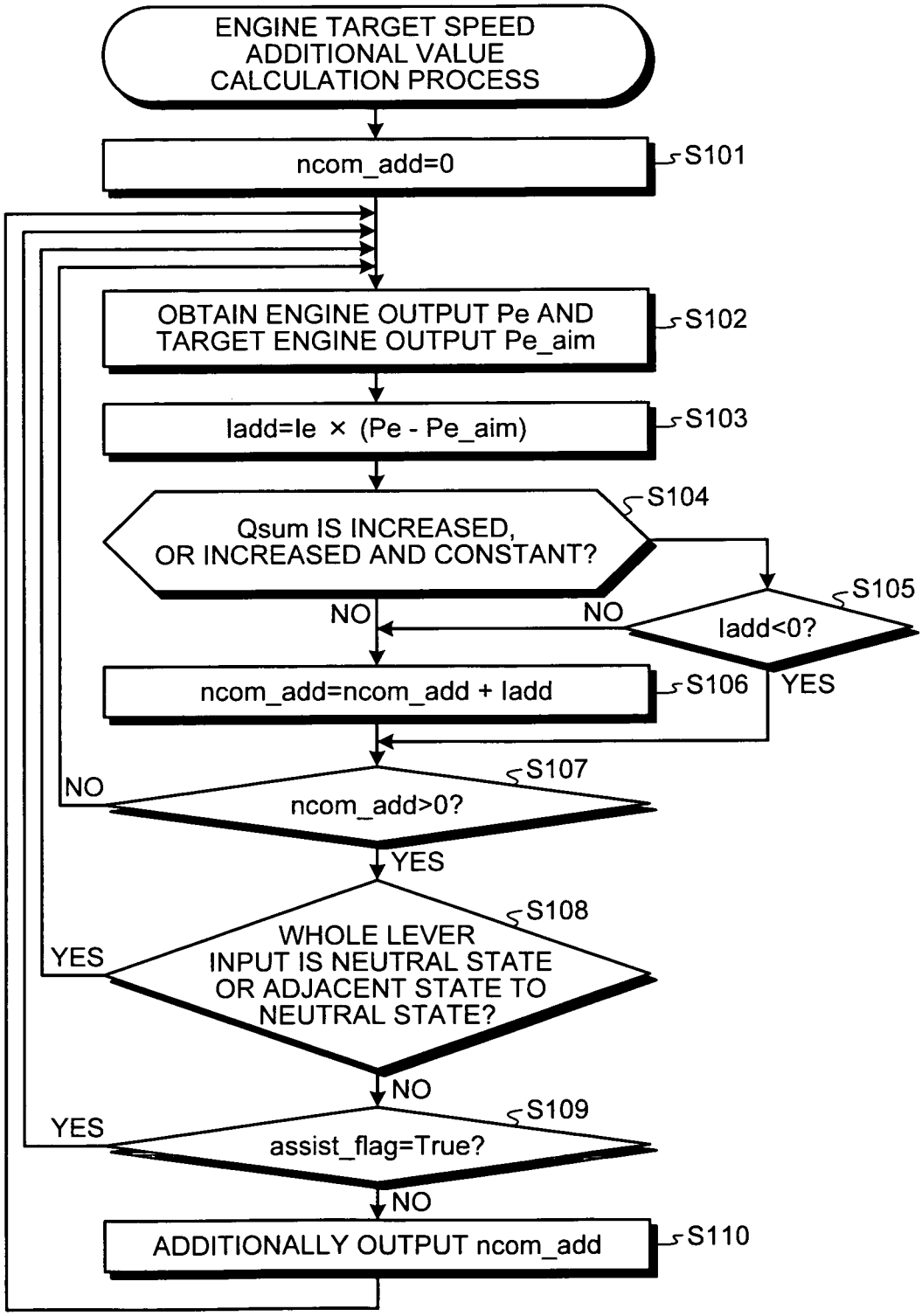
FIG. 4 is a flow chart illustrating a process of an engine target speed additional value calculation unit illustrated in FIG. 1.
Figure 6:
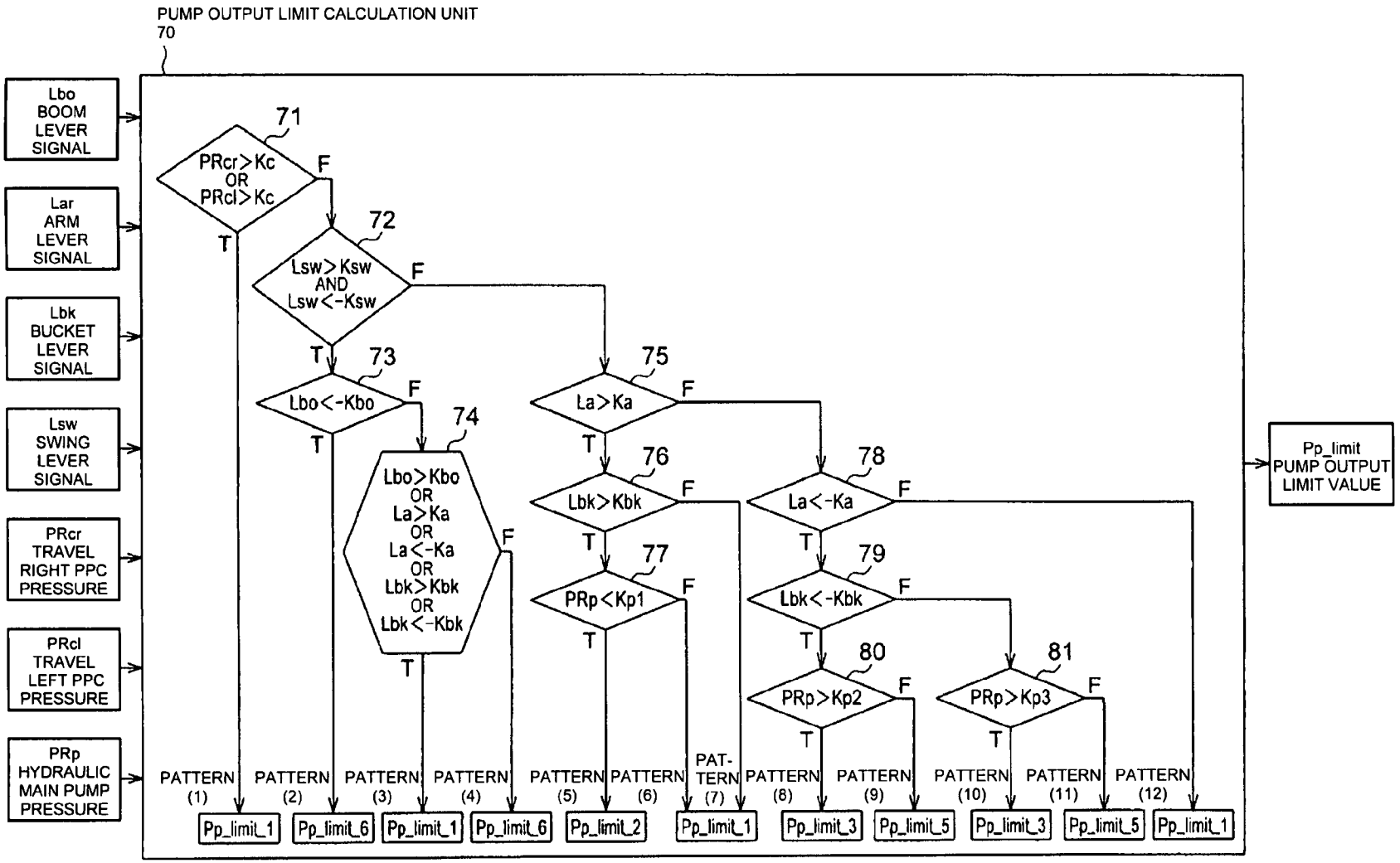
FIG. 6 is a flow chart illustrating a process flow of a pump output limit calculation unit illustrated in FIG. 2.

Next, a control process through the controller 6 will now be described. FIG. 2 is a flow chart illustrating a control flow through the controller 6. FIG. 3 is a flow chart illustrating a process flow of an target flow rate calculation unit illustrated in FIG. 2. FIG. 4 is a flow chart illustrating a process of an engine target speed additional value calculation unit illustrated in FIG. 2. FIG. 6 is a flow chart illustrating a process flow of a pump output limit calculation unit illustrated in FIG. 2.

First, referring to FIGS. 2 and 3, the boom lever signal Lbo, the arm lever signal Lar, the bucket lever signal Lbk, the swing lever signal Lsw, the right travel pilot pressure PRcr, and the left travel pilot pressure PRcl are input to an target flow rate calculation unit 50. Based on these values, an target flow rate Qbo of the boom cylinder 31, an target flow rate Qar of the arm cylinder 32, an target flow rate Qbk of the bucket cylinder 33, an target flow rate Qsw of the swing motor 34, an target flow rate Qcr of the right travel motor 35, and an target flow rate Qcl of the left travel motor 36 are calculated.

Functional relations 51*a*, 52*a*, 53*a*, 54*a*, 55*a*, and 56*a* between operation amounts and target flow rates respectively of hydraulic actuators are stored at a memory device in the controller 6 in a data table manner.

A boom target flow rate calculation unit 51 calculates the boom target flow rate Qbo corresponding to the Lbo indicating a current boom ascent direction operation amount or a current boom descent direction operation amount according to the functional relation 51*a*.

An arm target flow rate calculation unit 52 calculates the arm target flow rate Qa corresponding to Lar indicating a current arm excavation direction operation amount or a current arm dump direction operation amount according to the functional relation 52*a*.

A bucket target flow rate calculation unit 53 calculates the bucket target flow rate Qbk corresponding to Lbk indicating a current bucket excavation direction operation amount or a current bucket dump direction operation amount according to the functional relation 53*a*.

A swing target flow rate calculation unit 54 calculates the swing target flow rate Qsw corresponding to Lsw indicating a current right swing direction operation amount or a left swing direction operation amount according to the functional relation 54*a*.

A right travel target flow rate calculation unit 55 calculates the right travel target flow rate Qcr corresponding to the current right travel pilot pressure PRcr according to the functional relation 55*a*.

A left travel target flow rate calculation unit 56 calculates the left travel target flow rate Qcl corresponding to the current left travel pilot pressure PRcl according to the functional relation 56*a*.

In addition, the boom ascent operation amount, the arm excavation operation amount, the bucket excavation operation amount, the right swing operation amount are considered as operation amounts having plus symbols in the calculation process, and the boom descent operation amount, the arm dump operation amount, the bucket dump operation amount, the left swing operation amount are considered as operation amounts having minus symbols in the calculation process.

A pump target discharge flow rate calculation unit 60 performs a calculation process according to Formula 2 with the sum of the hydraulic actuator target flow rates Qbo, Qar, Qbk, Qsw, Qcr, and Qcl calculated at the hydraulic actuator target flow rate calculation unit 50 being considered as a pump target discharge flow rate Qsum.

$$Qsum=Qbo+Qar+Qbk+Qsw+Qcr+Qcl \quad (2)$$

where, although the sum of the target flow rates of the hydraulic actuators is considered as the pump target discharge flow rate, the maximum target flow rate of the target flow rates Qbo, Qar, Qbk, Qsw, Qcr, and Qcl respectively of the hydraulic actuators may be considered as an target discharge flow rate of the hydraulic pump 3.

A first engine target speed calculation unit 61 calculates a first engine target speed ncom1 corresponding to the pump target discharge flow rate Qsum calculated and output by the target flow rate calculation unit 50. A functional relation 61*a* that the first engine target speed ncom1 is increased according to the increase of the pump target discharge flow rate Qsum is memorized in a data table manner at the memory device of the controller 6. The first engine target speed ncom1 is a minimum engine speed at which the pump target discharge flow rate Qsum can be discharged when the hydraulic pump 3 is operated at a maximum capacity qmax according to Formula 3 with a transmission constant α.

$$ncom1=Qsum/qmax\cdot\alpha \quad (3)$$

At the first engine target speed calculation unit 61, the first engine target speed ncom1 corresponding to the current pump target discharge flow rate Qsum is calculated according to the functional relation 61*a*, that is, according to Formula 3.

A determination unit 62 of the controller 6 determines whether the current pump target discharge flow rate Qsum is greater than a predetermined flow rate Qmin. The predetermined flow rate, which is a threshold, is set as a flow rate to determine whether the operation levers 41, 42, 43, and 44 are operated at the neutral positions.

At a third engine target speed set unit 68 in the controller 6, when the current pump target discharge flow rate Qsum is equal to or less than the predetermined flow rate Qmin according to a determined result of the determination unit 62, that is, when a determined result is NO, a third engine target speed ncom3 is set to a speed nJ (for example, 1000 rpm) adjacent to a low idle speed nL of the engine 2. Accordingly, when the current pump target discharge flow rate Qsum is greater than the predetermined flow rate Qmin, that is, when a determined result is YES, the third engine target speed ncom3 is set to a speed nM (for example, 1400 rpm) greater than the low idle speed nL of the engine 2.

From the engine controller 4 to the controller 6, a current engine speed Ne of the engine 2 and an engine torque Te of the engine 2 estimated from a fuel injection amount are input. A filter 101 in the controller 6 has a time constant of about 0.5 sec and output an engine torque Te_f obtained by filtering the value of the input engine torque Te. An engine output calculation unit 102 in the controller 6 determines an engine output (horsepower) Pe by multiplying the engine speed Ne input from the engine controller 4 by the engine torque Te_f output from the filter 101, and transmission constant Const.

A target engine output calculation unit 103 in the controller 6 calculates an target engine output (horsepower) Pe_aim corresponding to a second engine target speed ncom2, to which an engine target speed additional value ncom_add (described later) is added, according to a functional relation 103*a*. An initial value of the second engine target speed ncom2 is the first engine target speed ncom1. Since the functional relation 103*a* is memorized at the memory device in the controller 6, the target engine output calculation unit 103 uses the functional relation 103*a* to output the target engine output Pe_aim.

Figure 7:
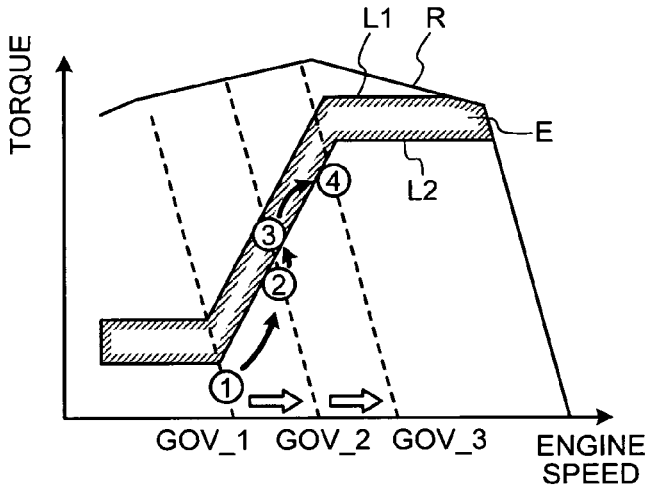
FIG. 7 is a torque graph illustrating a process through an engine target speed additional value calculation unit.
Figure 22:
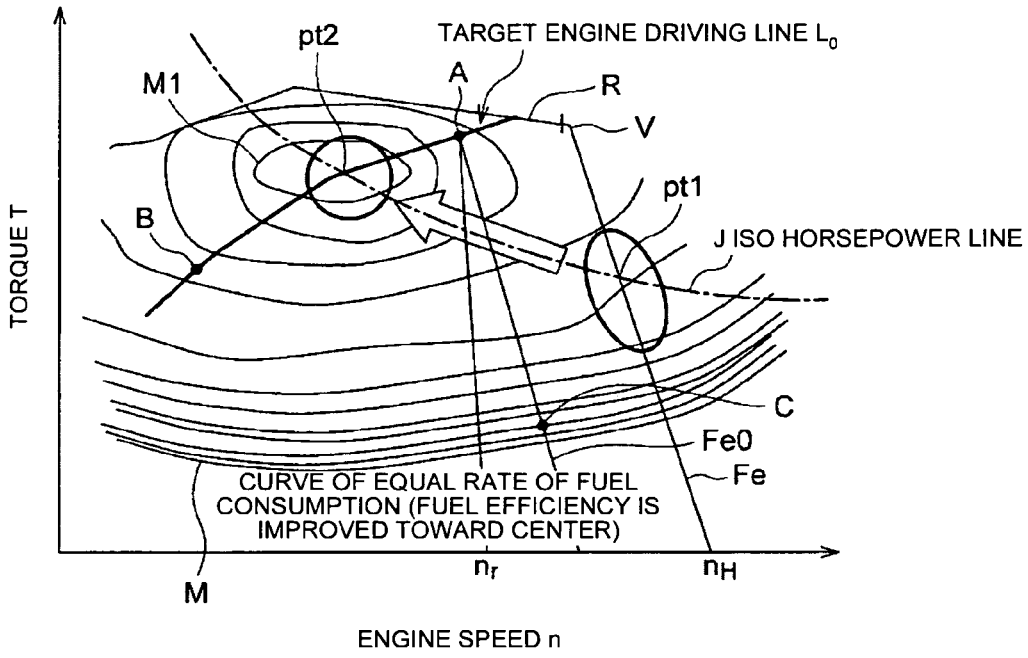
FIG. 22 illustrates a torque graph according to the related art.

The functional relation 103*a* is a load sensing boundary that is obtained by subtracting a predetermined horsepower from an target horsepower line obtained by multiplying an target torque line L1 as illustrated in FIG. 7, which is equal to an target engine driving line L0 as illustrated in FIG. 22, by an engine speed.

An engine target speed additional value calculation unit 104 in the controller 6 outputs the engine target speed additional value ncom_add according to the flow chart as illustrated in FIG. 4. Referring to FIG. 4, in step S101, the engine target speed additional value calculation unit 104 sets the engine target speed additional value ncom_add 0 as an initial value. Thereafter, in step S102, the engine output Pe is obtained from the engine output calculation unit 102, and the target engine output Pe_aim is obtained from the target engine output calculation unit 103. At this point, the target engine output calculation unit 103 uses the first engine target speed ncom1 as an initial value so as to output the target engine output Pe_aim, and then, sequentially uses the second engine target speed ncom2 to output the target engine output Pe_aim.

In addition, in step S103, the engine target speed additional value calculation unit 104 subtracts the target engine output Pe_aim from the engine output Pe, and multiplies a value, given by subtracting the target engine output Pe_aim from the engine output Pe, by a conversion coefficient Ie to obtain a value Iadd that is an engine speed.

Thereafter, in step S104, the engine target speed additional value calculation unit 104 determines whether the pump target discharge flow rate Qsum output by the target flow rate calculation unit 50 is increased or increased and constant. When the pump target discharge flow rate Qsum is not increased or not increased and constant (step S104, NO), the value Iadd is added to the engine target speed additional value ncom_add in step S106.

When the pump target discharge flow rate Qsum is increased or increased and constant (step S104, YES), it is determined whether the value Iadd is minus in step S105. When the value Iadd is not minus (step S105, NO), step S106 is performed to add the value Iadd to the engine target speed additional value ncom_add. When the value Iadd is minus (step S105, YES), step S107 is performed without the adding operation of the value Iadd.

Figure 5:
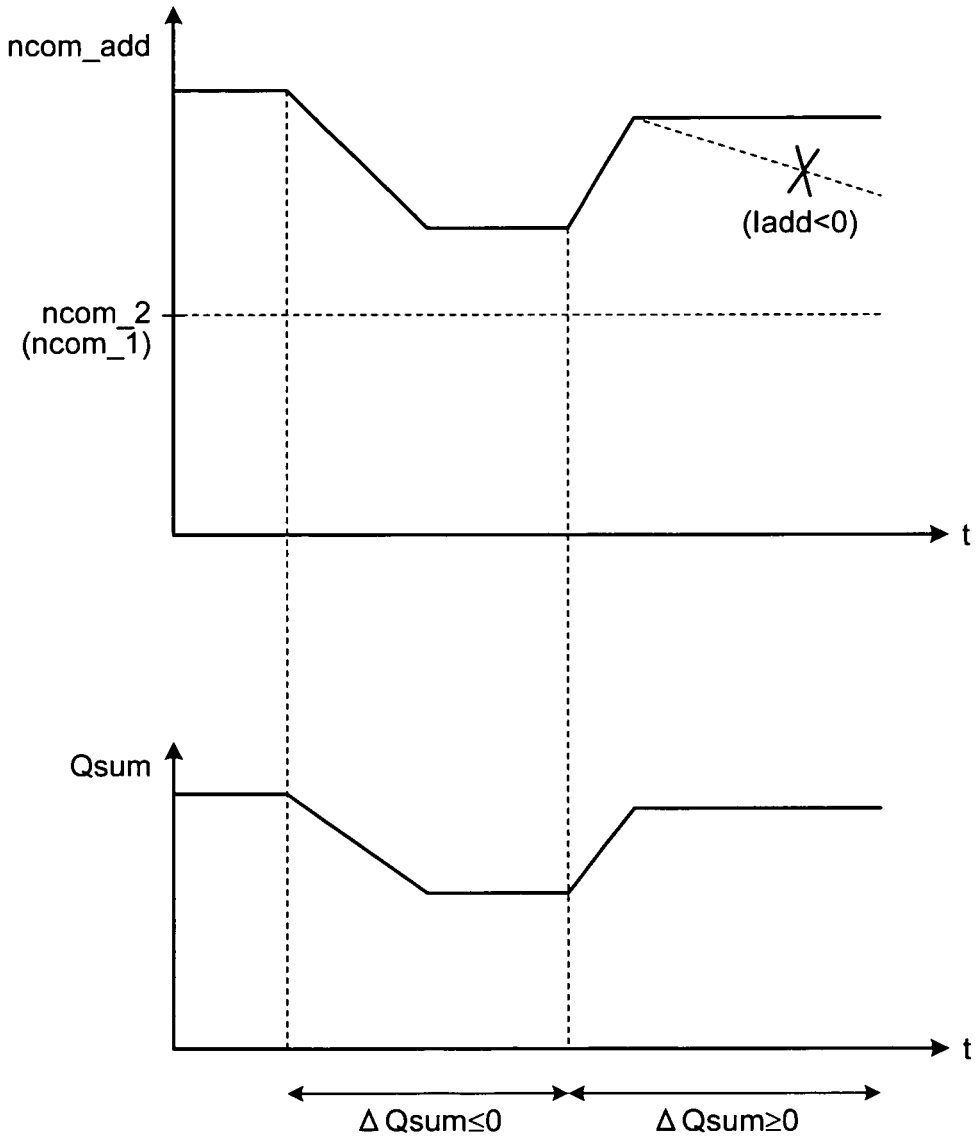
FIG. 5 is a flow chart illustrating an example of a process of an target speed additional value calculation unit illustrated in FIG. 2.

In step S104, step S105, and step S106, when the value Iadd is minus in the state where the pump target discharge flow rate Qsum that the target flow rate calculation unit 50 output is increased, or is increased and constant, the value Iadd is not added to the engine target speed additional value ncom_add. Particularly, in a state where an increase amount ΔQsum of the pump target discharge flow rate Qsum is equal to or greater than zero as illustrated in FIG. 5, even when the value Iadd is minus, the absolute value of the value Iadd is not subtracted from the engine target speed additional value ncom_add, and the current second engine target speed ncom2 is maintained. Accordingly, in the state where the pump target discharge flow rate Qsum is equal to or greater than zero, even when the value Iadd is minus, an engine target speed is not decreased until an operator operates a lever to reduce power, so as to stabilize a control system.

Thereafter, in step S107, it is determined whether the engine target speed additional value ncom_add is plus. When the engine target speed additional value ncom_add is plus (step S107, YES), it is determined whether the whole lever input (lever potentio signal) is one of the neutral state and a state adjacent to the neutral state or not in step S108. When the whole lever input is not one of the neutral state or the state adjacent to the neutral state (step S108, NO), it is determined whether an assist flag assist_flag that will be described later is true or not in step S109.

When the engine target speed additional value ncom_add is plus (step S107, YES), when the whole lever input is not one of the neutral state and the state adjacent to the neutral state (step S108, NO), and when the assist flag assist_flag is not true (step S109, NO), the engine target speed additional value ncom_add is added to the first engine target speed ncom1 in step S110 to generate the second engine target speed ncom2 (corresponding to a correction engine target speed), step S102 is performed again, and then the aforementioned process is repeated.

When the engine target speed additional value ncom_add is not plus (step S107, NO), when the whole lever input is one of the neutral state and the state adjacent to the neutral state (step S108, YES), or when the assist flag assist_flag is true (step S109, YES), the engine target speed additional value ncom_add is not added to the first engine target speed ncom1, the current first engine target speed ncom1 is output as the second engine target speed (corresponding to a correction engine target speed), step S102 is performed again, and then the aforementioned process is repeated.

The case where the engine target speed additional value ncom_add is not plus means that the engine target speed additional value ncom_add is not closer to the load sensing boundary and a load is not great. Thus, it is unnecessary to increase the speed of the engine. In addition, when the whole lever input is one of the neutral state or the state adjacent to the neutral state, an operator's selection is prioritized. Furthermore, when the assist flag assist_flag is true, the engine 2 is assisted by the electric motor without increasing an engine speed.

Accordingly, the output engine target speed additional value ncom_add is added to the first engine target speed ncom1 by an addition unit 105, and is output as the second engine target speed ncom2. In addition, the second engine target speed ncom2 is output to the target engine output calculation unit 103 through a branch unit 106.

A maximum value selection unit 64 in the controller 6 selects a greater one ncom23 of the second engine target speed ncom2 and the third engine target speed ncom3.

A pump output limit calculation unit 70 operates according to the flow chart as illustrated in FIG. 6. Hereinafter, the determined result TRUE is denoted by T, and a determined result FALSE is denoted by F.

A work pattern of the hydraulic actuators 21, 22, 23, 24, 25, and 26 is determined as an operation pattern 1 that is a travel operation, and an output limit value Pplimit of the hydraulic pump 3 is set as Pplimit1 to be adapted for the travel operation as the work pattern.

At the pump output limit calculation unit 70, the output (horsepower) limit value Pplimit of the hydraulic pump 3 is calculated according to the work pattern of the hydraulic actuators 21, 22, 23, 24, 25, and 26.

Figure 9:
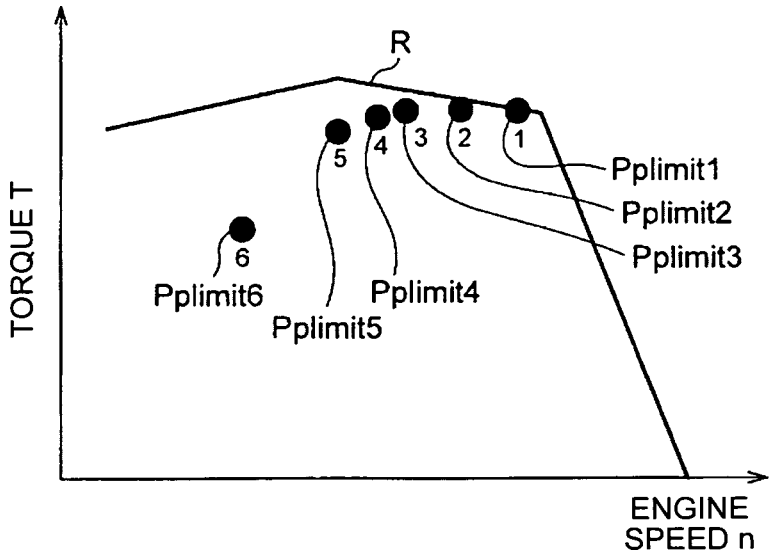
FIG. 9 is a graph illustrating pump output limit value respectively corresponding to work patterns.

Pplimit1, Pplimit3, Pplimit4, Pplimit5, and Pplimit6 are previously calculated as output limit values of the hydraulic pump 3. The output limit values of the hydraulic pump 3 are set in descending order of Pplimit1, Pplimit2, Pplimit3, Pplimit4, Pplimit5, and Pplimit6 as illustrated in a torque curve graph of FIG. 9.

That is, when the right travel pilot pressure PRcr is greater than a predetermined pressure Kc, or when the left travel pilot pressure PRcl is greater than the predetermined pressure Kc (a determination T in step 71), it is determined that the work pattern of the hydraulic actuators 21, 22, 23, 24, 25, and 26 is the work pattern 1 as the travel operation, and the output limit value Pplimit of the hydraulic pump 3 is set as Pplimit1 to be adapted for the travel operation as the work pattern.

Hereinafter, in same manners, steps 72 through 79 are performed as follows. That is, in step 72, it is determined whether the right swing operation amount Lsw is greater than a predetermined operation amount Ksw or not, and whether the left swing operation amount Lsw is less than a predetermined operation amount−Ksw or not.

In step 73, it is determined whether the boom ascent operation amount Lbo is less than a predetermined operation amount−Kbo or not.

In step 74, it is determined whether the boom ascent operation amount Lbo is greater than a predetermined operation amount Kbo or not, or whether an arm excavation operation amount La is greater than a predetermined operation amount Ka or not, or whether the arm dump operation amount La is less than a predetermined operation amount−Ka or not, or whether the bucket excavation operation amount Lbk is greater than a predetermined operation amount Kbk or not, or whether the bucket dump operation amount Lbk is less than a predetermined operation amount Kbk or not.

In step 75, it is determined whether the arm excavation operation amount La is greater than the predetermined operation amount Ka or not.

In step 76, it is determined whether the bucket excavation operation amount Lbk is greater than the predetermined operation amount Kbk or not.

In step 77, it is determined whether the discharge pressure PRp of the hydraulic pump 3 is less than a predetermined pressure Kp1 or not.

In step 78, it is determined whether the arm dump operation amount La is less than the predetermined operation amount−Ka or not.

In step 79, it is determined whether the bucket dump operation amount Lbk is less than the predetermined operation amount−Kbk or not.

In step 80, it is determined whether the discharge pressure PRp of the hydraulic pump 3 is greater than a predetermined pressure Kp2 or not.

In step 81, it is determined whether the discharge pressure PRp of the hydraulic pump 3 is greater than a predetermined pressure Kp3 or not.

When a determination of step 71 is F, when a determination of step 72 is T, and when a determination of step 73 is T, it is determined that the work pattern of the hydraulic actuators 21, 22, 23, 24, 25, and 26 is a work pattern 2 of a swing operation and a boom descent operation, and the output limit value Pplimit of the hydraulic pump 3 is set to Pplimit6 to be adapted for the work pattern 2.

When a determination of step 71 is F, when a determination of step 72 is T, when a determination of step 73 is F, and when a determination of step 74 is T, it is determined that the work pattern of the hydraulic actuators 21, 22, 23, 24, 25, and 26 is a work pattern 3 of an operation of the work machine except for the swing operation and the boom descent operation, and the output limit value Pplimit of the hydraulic pump 3 is set to Pplimit1 to be adapted for the work pattern 3.

When a determination of step 71 is F, when a determination of step 72 is T, when a determination of step 73 is F, and when a determination of step 74 is F, it is determined that the work pattern of the hydraulic actuators 21, 22, 23, 24, 25, and 26 is a work pattern 4 of the single swing operation, and the output limit value Pplimit of the hydraulic pump 3 is set to Pplimit6 to be adapted for the work pattern 4.

When a determination of step 71 is F, when a determination of step 72 is F, when a determination of step 75 is T, when a determination of step 76 is T, and when a determination of step 77 is T, it is determined that the work pattern of the hydraulic actuators 21, 22, 23, 24, 25, and 26 is a work pattern 5 of an arm excavation operation and a bucket excavation operation at a small load (for example, an operation of collecting earth and sand), and the output limit value Pplimit of the hydraulic pump 3 is set to Pplimit2 to be adapted for the work pattern 5.

When a determination of step 71 is F, when a determination of step 72 is F, when a determination of step 75 is T, when a determination of step 76 is T, and when a determination of step 77 is F, it is determined that the work pattern of the hydraulic actuators 21, 22, 23, 24, 25, and 26 is a work pattern 6 of an arm excavation operation and a bucket excavation operation at a great load (for example, an excavation operation of both the arm and the bucket), and the output limit value Pplimit of the hydraulic pump 3 is set to Pplimit1 to be adapted for the work pattern 6.

When a determination of step 71 is F, when a determination of step 72 is F, when a determination of step 75 is T, and when a determination of step 76 is F, it is determined that the work pattern of the hydraulic actuators 21, 22, 23, 24, 25, and 26 is a work pattern 7 of an arm excavation operation, and the output limit value Pplimit of the hydraulic pump 3 is set to Pplimit1 to be adapted for the work pattern 7.

When a determination of step 71 is F, when a determination of step 72 is F, when a determination of step 75 is F, when a determination of step 78 is T, when a determination of step 79 is T, and when a determination of step 80 is T, it is determined that the work pattern of the hydraulic actuators 21, 22, 23, 24, 25, and 26 is a work pattern 8 of an arm earth removal operation and a bucket earth removal operation at a great load (for example, an operation of pushing earth and sand by both the arm and the bucket), and the output limit value Pplimit of the hydraulic pump 3 is set to Pplimit3 to be adapted for the work pattern 8.

When a determination of step 71 is F, when a determination of step 72 is F, when a determination of step 75 is F, when a determination of step 78 is T, when a determination of step 79 is T, and when a determination of step 80 is F, it is determined that the work pattern of the hydraulic actuators 21, 22, 23, 24, 25, and 26 is a work pattern 9 of an arm earth removal operation and a bucket earth removal operation at a small load (for example, an operation of simultaneously reversing both the arm and the bucket in air), and the output limit value Pplimit of the hydraulic pump 3 is set to Pplimit5 to be adapted for the work pattern 9.

When a determination of step 71 is F, when a determination of step 72 is F, when a determination of step 75 is F, when a determination of step 78 is T, when a determination of step 79 is F, and when a determination of step 81 is T, it is determined that the work pattern of the hydraulic actuators 21, 22, 23, 24, 25, and 26 is a work pattern 10 of a single arm earth removal operation at a great load (for example, an operation of pushing earth and sand by the arm), and the output limit value Pplimit of the hydraulic pump 3 is set to Pplimit3 to be adapted for the work pattern 10.

When a determination of step 71 is F, when a determination of step 72 is F, when a determination of step 75 is F, when a determination of step 78 is T, when a determination of step 79 is F, and when a determination of step 81 is F, it is determined that the work pattern of the hydraulic actuators 21, 22, 23, 24, 25, and 26 is a work pattern 11 of a single arm earth removal operation at a small load (for example, an operation of reversing the arm in air), and the output limit value Pplimit of the hydraulic pump 3 is set to Pplimit5 to be adapted for the work pattern 11.

When a determination of step 71 is F, when a determination of step 72 is F, when a determination of step 75 is F, and when a determination of step 78 is F, it is determined that the work pattern of the hydraulic actuators 21, 22, 23, 24, 25, and 26 is a work pattern 12 of the other operation, and the output limit value Pplimit of the hydraulic pump 3 is set to Pplimit1 to be adapted for the work pattern 12.

In a relief operation, the discharge pressure PRp of the hydraulic pump 3 is input to a pump output limit value calculation unit 500, and the output limit value Pplimit of the hydraulic pump 3 with respect to the discharge pressure PRp of the hydraulic pump 3 is calculated. The output limit value Pplimit is calculated based on a function relation 500*a* of the output limit value Pplimit with respect to the discharge pressure PRp to prevent a rapid pump output variation in the relief operation. The function relation is stored in the memory device of the controller 6.

Thereafter, a minimum selection unit 501 selectively output the smaller one of the output limit value Pplimit output from the pump output limit value calculation unit 70 and the output limit value Pplimit output from the pump output limit value calculation unit 500 in the relief operation.

Next, a fourth engine target speed calculation unit 63 in the controller 6 calculates a fourth engine target speed ncom4 corresponding to the output limit value Pplimit selected by the minimum selection unit 501.

A functional relation 63*a* that the third engine target speed ncom3 is increased according to the increase of the output limit value Pplimit of the hydraulic pump 3 is memorized in a data table manner at the memory device of the controller 6.

At the fourth engine target speed calculation unit 63, the fourth engine target speed ncom4 corresponding to the current work pattern of the hydraulic actuators 21, 22, 23, 24, 25, and 26, that is, to the output limit value Pplimit of the hydraulic pump 3 is calculated according to the functional relation 63*a*.

At a minimum value selection unit 65, a less one ncom of the engine target speed ncom23 selected at the maximum value selection unit 64 and the fourth engine target speed ncom4 is selected.

The controller 6 output a rotation command value for setting an engine speed n as the target speed ncom to the engine controller 4, and the controller 4 increases or decreases a fuel injection amount to obtain the engine target speed ncom on the target torque line L1 as illustrated in FIG. 7.

Referring to FIG. 7, when the engine 2 and the hydraulic pump 3 are controlled according to the target torque line L1 where the pump absorption torque Tpcom is decreased according to the decrease of the engine speed n, fuel efficiency, engine efficiency, and pump efficiency are improved, noises are reduced, and engine stop is prevented, but response performance of the engine 2 is degraded. For example, when the operation lever 41 is tilted from the neutral position to increase a low speed of the engine 2 and start an excavation operation, in an initial state (excessive state) where the tilting of the operation lever is started, the load of the hydraulic pump 3 is rapidly increased, so a pump absorption horsepower portion of the output of the engine is insufficient, so that power for accelerating the engine 2 is insufficient. Accordingly, the speed of the engine 2 is not increased to an target speed, or is just excessively slowly increased.

At this point, in the current embodiment, the second engine target speed ncom2, given by adding the engine target speed additional value ncom_add to the first engine target speed ncom1 adapted for the current pump target discharge flow rate Qsum, is set. Meanwhile, when it is determined that the current pump target discharge flow rate Qsum is greater than a predetermined flow rate (for example, 10 L/min), the third engine target speed ncom3 is set to the speed nM (for example, 1400 rpm) greater than the low idle speed nL of the engine. When the third engine target speed ncom3 is equal to or greater than the second engine target speed ncom2, the speed of the engine is controlled to obtain the third engine target speed ncom3.

Thus, for example, when the operation lever 41 is tilted from the neutral position to start an excavation operation, before the load of the hydraulic pump 3 is rapidly increased, the speed of the engine is increased, and the torque of the engine is increased, so that power for accelerating the engine 2 is sufficient. Thus, the response performance of the engine 2 is improved, so that a low speed of the engine 2 is quickly increased to a target speed.

In addition, in the current embodiment, the engine target speed additional value calculation unit 104 adds the engine target speed additional value ncom_add to the first engine target speed ncom1. When the current engine output Pe is greater than the target engine output Pe_aim corresponding to the second engine target speed ncom2, the engine target speed additional value calculation unit 104 adds the engine target speed additional value ncom_add according to the difference between the current engine output Pe and the target engine output Pe_aim to the first engine target speed ncom1, so as to increase the speed of the engine.

Figure 8:
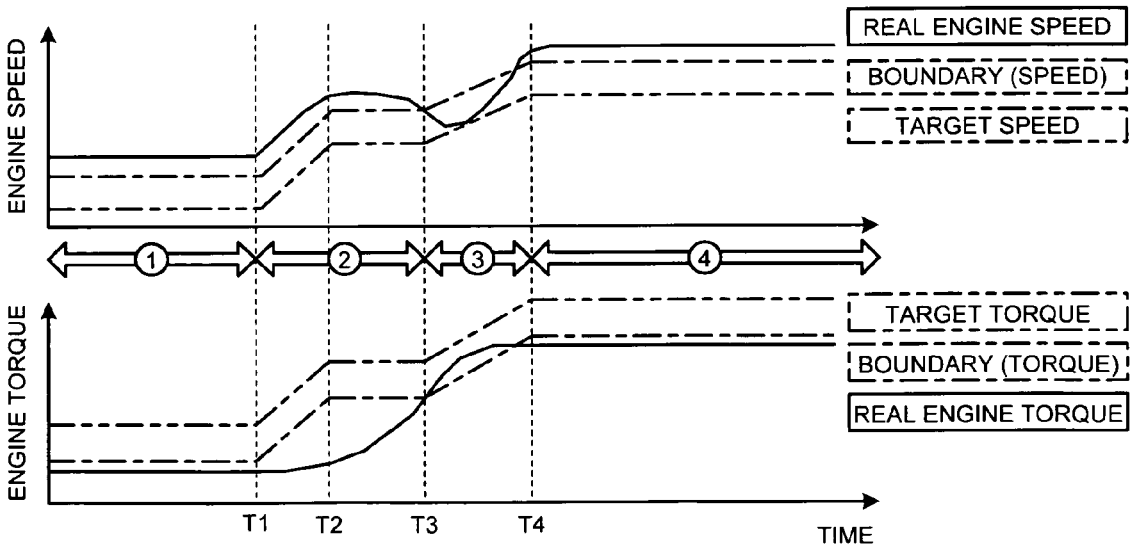
FIG. 8 is a graph illustrating time variations of an engine speed and an engine torque for describing a process through an engine target speed additional value calculation unit.

Referring to FIGS. 7 and 8, a process in which the speed of the engine is increased by the engine target speed additional value calculation unit 104 will now be described. In addition, for convenience in description, a torque graph is illustrated instead of a horsepower graph. FIG. 7 is a torque graph illustrating an engine torque variation according to an engine speed. The torque graph is the same as that of FIG. 22. The target engine driving line L0 corresponds to the target torque line L1. A load sensing torque boundary L2 is lower than the target torque line L1 by a predetermined torque. The load sensing boundary is obtained by multiplying the load sensing torque boundary L2 by an engine speed, and is the functional relation 103*a* of the target engine output calculation unit 103. A region surrounded by the target torque line L1 and the load sensing torque line L2 is referred to as a load sensing region E, and the load sensing torque boundary L2 is the boundary of the load sensing region E. That is, the load sensing region E is defined as a region closer to the target torque line L1. It is assumed that a construction machine requires output in the load sensing region E, and thus, an engine speed is increased in the load sensing region E.

FIG. 8 is a graph illustrating time variations of an engine speed and an engine torque when a lever input is performed. In FIGS. 7 and 8, a state 1 is an idle state, and the engine speed is GOV_1. When the lever input starts at a time point T1, the engine speed is increased according to a lever operation, and reaches a state 2. The engine speed is GOV_2 at a time point T2 when a lever is fixed. In the state 2, the torque is slowly increased over time. At a time point T3 when the state 2 is finished, the engine speed and torque are over the load sensing torque boundary L2. That is, the engine speed is equal to or less than the engine speed of the load sensing torque boundary L2, and the engine torque is equal to or greater than the torque of the load sensing torque boundary L2. A state where the engine torque is over the load sensing torque boundary L2 and disposed in the load sensing region E is a state 3. In the state 3, the engine target speed additional value calculation unit 104 adds the engine target speed additional value ncom_add to the first engine target speed ncom1, so as to increase the engine speed. Thus, the engine speed is increased and the engine torque is decreased in the latter part of the state 3, and at a time T4 when the state 3 is finished, the engine speed and the engine torque are under the load sensing torque boundary L2, and the engine target speed additional value calculation unit 104 does not increase the engine speed.

Accordingly, in the current embodiment, when the engine speed and the engine torque is in the load sensing region E, since the increase of the output is required, the engine speed is increased. Particularly, an additional lever operation is not required for a load applied after a lever is operated, and an engine speed is automatically increased, so that output is increased, thus improving the handling of an operator. That is, when a great load is applied, output is automatically increased.

In addition, in the current embodiment, the second engine target speed ncom2 given by adding the engine target speed additional value ncom_add to the first engine target speed ncom1 adapted for the current pump target discharge flow rate Qsum is set, and the minimum output limit value Pplimit of the output limit value Pplimit of the hydraulic pump 3 set according to the work pattern of the hydraulic actuators 21, 22, 23, 24, 25, and 26, and the output limit value Pplimit corresponding to a discharge pressure of the hydraulic pump 3 considering a high load pressure state in the relief operation is selected, and the fourth engine target speed ncom4 corresponding to the selected output limit value Pplimit is set. When the fourth engine target speed ncom4 is equal to or less than the engine target speed ncom23, an engine speed is controlled to obtain the fourth engine target speed ncom4.

That is, in the current embodiment, through the fourth engine target speed calculation unit 63 and the pump output limit value calculation unit 500 in the relief operation, when a relief state is achieved, an engine speed is decreased instead of limiting a pump absorption torque. In this case, since the same pump output as that of the case where the pump absorption torque is limited can be obtained and the engine speed is decreased, the engine efficiency is improved without decreasing the pump efficiency, thus reducing energy consumption and improving noises.

In addition, in the current embodiment, the minimum value of the output limit value output from the pump output limit calculation unit 70 and the output limit value output from the pump output limit value calculation unit 500 in the relief operation is selected, and then, the fourth engine target speed is determined, but the invention is not limited thereto. Thus, discretely from a process route from the pump output limit value calculation unit 70 through the minimum selection unit 501 to the fourth engine target speed calculation unit 63, the pump output limit value calculation unit 500 in the relief operation and the fourth engine target speed calculation unit 63 are arranged, and a fifth engine target speed corresponding to the fourth engine target speed with respect to a discharge pressure may be directly calculated and output to the minimum value selection unit 65.

Figure 10:
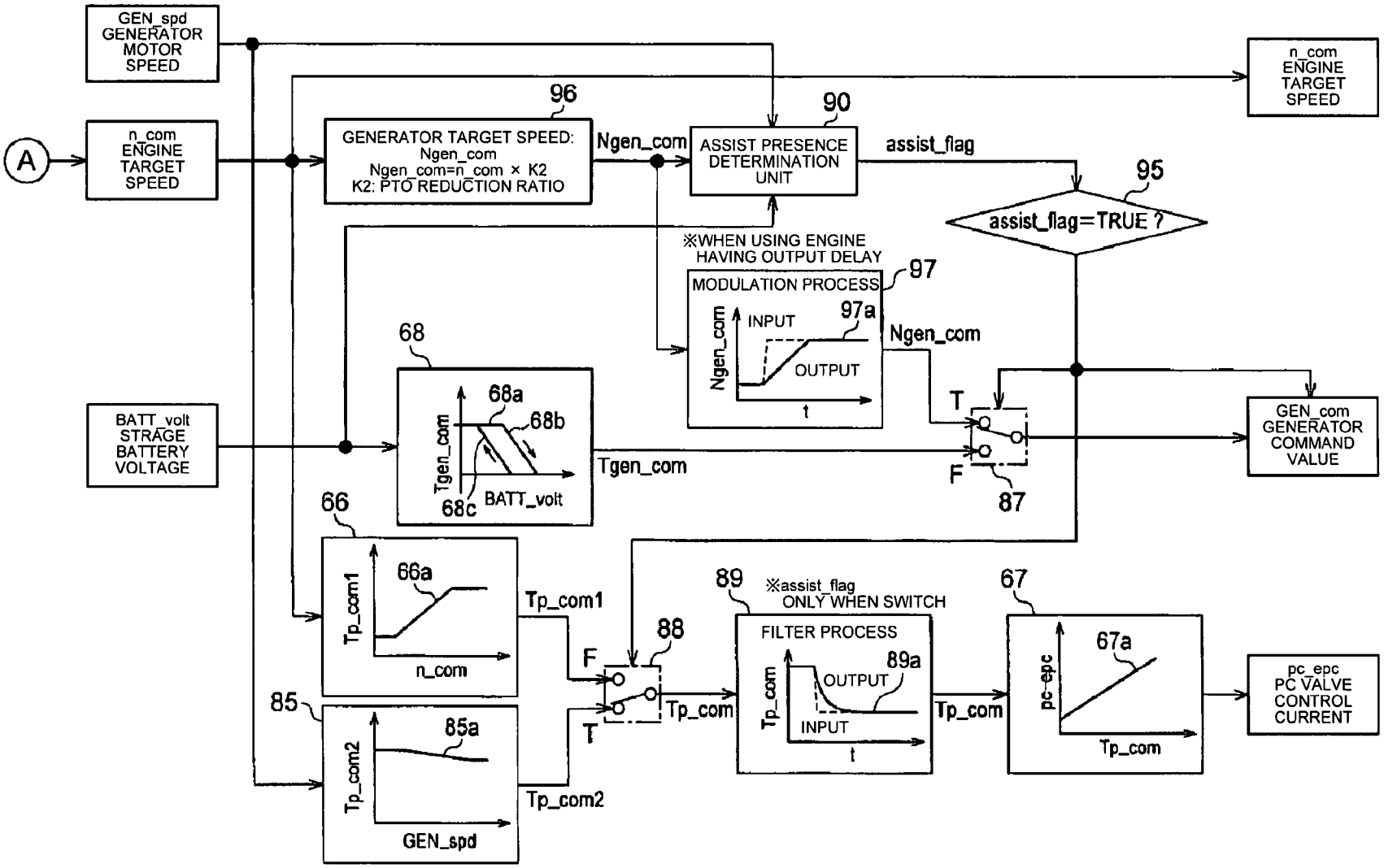
FIG. 10 is a second flow chart illustrating a control flow of a controller illustrated in FIG. 1.
Figure 11:
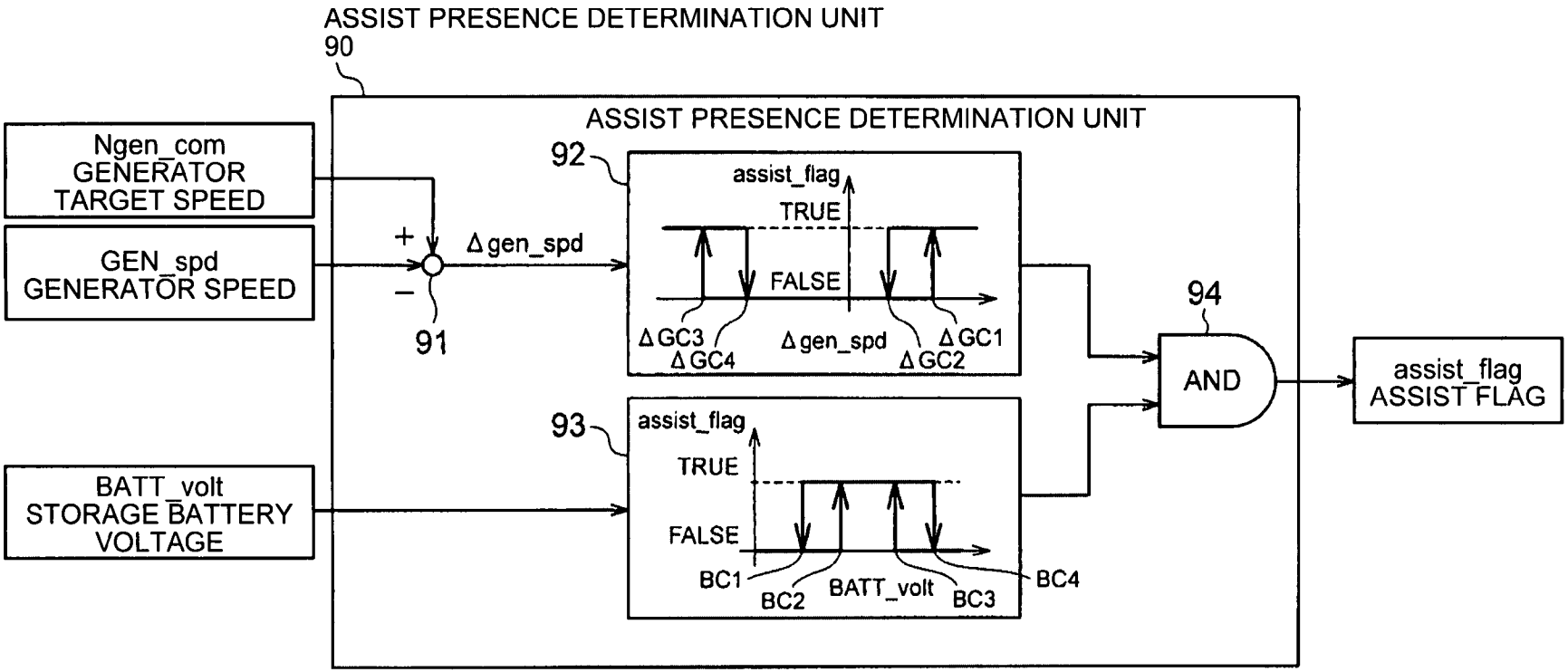
FIG. 11 is a flow chart illustrating a process flow of an assist presence determination unit.

Referring to FIGS. 10 and 11, an assist control process performed by the controller 6 of the construction machine 1 will now be described.

To the assist control process illustrated in FIG. 10, the engine target speed ncom selected at the minimum value selection unit 65 illustrated in FIG. 2 is input.

In addition, hereinafter, an engine speed and an engine target speed are respectively converted into a generator motor speed and a generator motor target speed, and then, a calculation process is performed. Alternatively, the generator motor speed and the generator motor target speed may be respectively replaced with the engine speed and the engine target speed, and then, a calculation process may be performed.

At the generator motor target speed calculation unit 96, an target speed Ngen_com of the generator motor 11 corresponding to the current engine target speed ncom is calculated according to Formula 4.

$$Ngen_com = ncom \times K2 \quad (4)$$

where K2 is the reduction ratio of the PTO shaft 10.

At an assist presence determination unit 90, based on the target speed Ngen_com of the generator motor 11, the current real speed GEN_spd of the generator motor 11 detected at the rotation sensor 14, and the current voltage BATT_volt of the storage battery 12 detected at the voltage sensor 15, it is determined whether the engine 2 is assisted by the generator motor 11 or not (assistance presence).

Referring to FIG. 11, at a deviation calculation unit 91 of the assist presence determination unit 90, a deviation Δgen_spd of the target speed Ngen_com and the real speed GEN_spd of the generator motor is calculated.

Next, at a first determination unit 92, it is determined that, when the deviation Δgen_spd of the target speed Ngen_com and the real speed GEN_spd of the generator motor is equal to or greater than a first threshold ΔGC1, the generator motor 11 performs electric motor action, and the assist flag assist_flag is T. It is determined that, when the deviation Δgen_spd of the target speed Ngen_com and the real speed GEN_spd of the generator motor is equal to or less than a second threshold ΔGC2 that is less than the first threshold ΔGC1, the generator motor 11 does not perform electric motor action (a generation action may be performed to store power in the storage battery 12 if necessary), and the assist flag is F.

When the deviation Δgen_spd of the target speed Ngen_com and the real speed GEN_spd of the generator motor is equal to or less than a third threshold ΔGC3, it is determined that the generator motor 11 performs generation action, and the assist flag assist_flag is T. When the deviation Δgen_spd of the target speed Ngen_com and the real speed GEN_spd of the generator motor is equal to or greater than a fourth threshold ΔGC4 that is greater than the third threshold ΔGC3, it is determined that the generator motor 11 does not perform generation action (generation action may be performed to store power in the storage battery 12 if necessary), and the assist flag is F.

As such, when the deviation Δgen_spd of rotation speed is plus and increased to be greater than a predetermined value, the generator motor 11 performs electric motor action to assist the engine 2. Thus, when a current engine speed and an engine target speed is deviated, the engine speed is quickly increased toward the engine target speed.

For example, when the hydraulic pump is quickly changed from a high load pressure state to a low load pressure state, until an engine real speed is over a preset value with respect to an engine target speed, the engine speed is controlled such that the engine torque assist action of the generator motor is used to make the engine real speed be the same as the engine target speed. That is, when the hydraulic pump is quickly changed from a high load pressure state to a low load pressure state, the fourth engine target speed is increased, so that a deviation of the fourth engine target speed and a real speed is increased. However, in this case, the engine torque assist action is performed.

In addition, as described above, the fourth engine target speed is increased in response to the case where the hydraulic pump is changed from a high load pressure state to a low load pressure state, and thus, when a real speed of the engine is less than an engine target speed and a preset value, until the real speed is increased over the value smaller than the engine target speed and the preset value, the engine torque assist action of the generator motor is used to control the engine speed such that the engine speed is equal to the target speed.

In addition, when the speed deviation Δgen_spd is minus and increased to be greater than a predetermined value, the generator motor 11 performs generation action to reversely assist the engine 2. Thus, when an engine speed is decreased, generation action is performed to quickly decrease the engine speed and recycle energy of the engine 2.

A hysteresis is disposed between the first threshold ΔGC1 and the second threshold ΔGC2, and a hysteresis is disposed between the third threshold ΔGC3 and the fourth threshold ΔGC4, thus preventing hunting in control.

At a second determination unit 93, when the voltage BATT_volt of the storage battery 12 is stably disposed in a predetermined range from BC1 to BC4 (BC2 to BC3), the assist flag assist_flag is T, and when the voltage BATT_volt of the storage battery 12 is out of the predetermined range from BC1 to BC4 (BC2 to BC3), the assist flag assist_flag is F.

A first threshold BC1, a second threshold BC2, a third threshold BC3, and a fourth threshold BC4 are set at the voltage BATT_volt in an ascending order of the first threshold BC1, the second threshold BC2, the third threshold BC3, and the fourth threshold BC4.

When the voltage BATT_volt of the storage battery 12 is equal to or less than the third threshold BC3, the assist flag assist_flag is T. When the voltage BATT_volt of the storage battery 12 is equal to or greater than the fourth threshold BC4, the assist flag assist_flag is F. When the voltage BATT_volt of the storage battery 12 is equal to or greater than the second threshold BC2, the assist flag assist_flag is T. When the voltage BATT_volt of the storage battery 12 is equal to or less than the first threshold BC1, the assist flag assist_flag is F.

As such, only when the voltage BATT_volt of the storage battery 12 is stably disposed in the predetermined range from BC1 to BC4 (BC2 to BC3), the assist operation is performed. Accordingly, an assist operation is not performed at a low voltage and a high voltage out of the predetermined range, thus preventing overcharge or full discharge applied to the storage battery 12.

A hysteresis is disposed between the first threshold BC1 and the second threshold BC2, and a hysteresis is disposed between the third threshold BC3 and the fourth threshold BC4, thus preventing hunting in control.

At an AND circuit 94, when the assist flag assist_flag obtained at the first determination unit 92 and the assist flag assist_flag obtained at the second determination unit 93 are simultaneously T, the content of the assist flag assist_flag is finally T, and in the other cases, the content of the assist flag assist_flag is finally F.

The assist flag assist_flag is output from the assist presence determination unit 90 to the engine target speed additional value calculation unit 104. When the assist flag assist_flag is True, the engine target speed additional value calculation unit 104 does not perform an additional output of the engine target speed additional value ncom_add.

At an assist flag determination unit 95, it is determined whether the content of the assist flag assist_flag output from the assist presence determination unit 90 is T or not.

At a generator motor command value switch unit 87, the content of the generator motor command value GEN_com to be provided to the inverter 13 is switched into an target speed or an target torque according to whether the determined result of the assist flag determination unit 95 is T or not (F).

The speed or the torque of the generator motor 11 is controlled through the inverter 13.

In this case, the control of the speed is performed by providing an target speed as the generator motor command value GEN_com to adjust the speed of the generator motor 11 and obtain the target speed. The control of the torque is performed by providing an target torque as the generator motor command value GEN_com to adjust the torque of the generator motor 11 and obtain the target torque.

At a modulation process unit 97, an target speed of the generator motor 11 is calculated and output. In addition, at a generator motor torque calculation unit 68, an target torque of the generator motor 11 is calculated and output.

That is, with respect to the generator motor target speed Ngen_com obtained at the generator motor target speed calculation unit 96, the modulation process unit 97 outputs the speed Ngen_com on which a modulation process is performed according to a characteristic 97*a*. Instead of outputting the generator motor target speed Ngen_com input from the generator motor target speed calculation unit 96 as it is, the generator motor target speed Ngen_com is multiplied by a time t to slowly increase a speed and reach the generator motor target speed Ngen_com input from the generator motor target speed calculation unit 96.

Comparing with a case where the modulation process is not performed, the effect of a case where the modulation process is performed will now be described with reference to torque graphs as illustrated in FIGS. 12 through 15.

Figure 12:
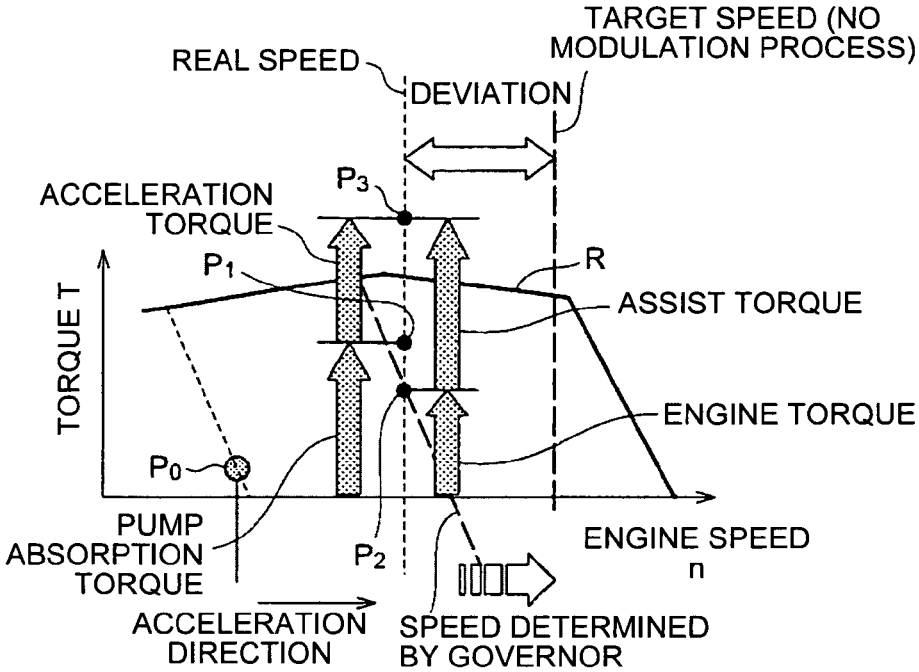
FIG. 12 is a graph illustrating an operation on which a modulation process is not performed when an engine is accelerated.
Figure 13:
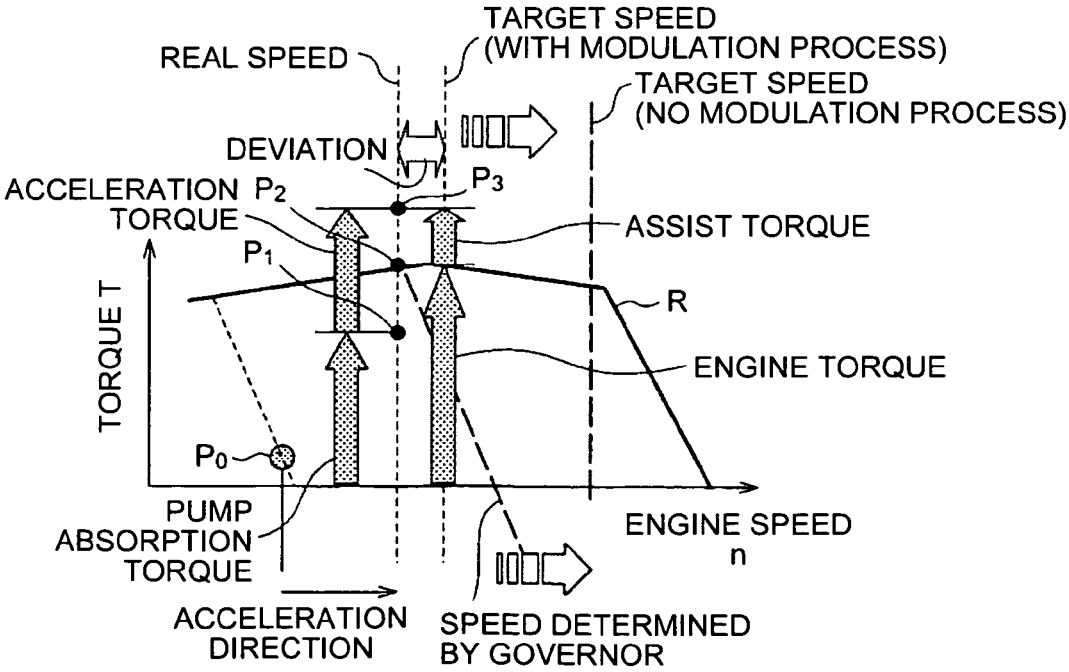
FIG. 13 is a graph illustrating an operation on which a modulation process is performed when an engine is accelerated.
Figure 14:
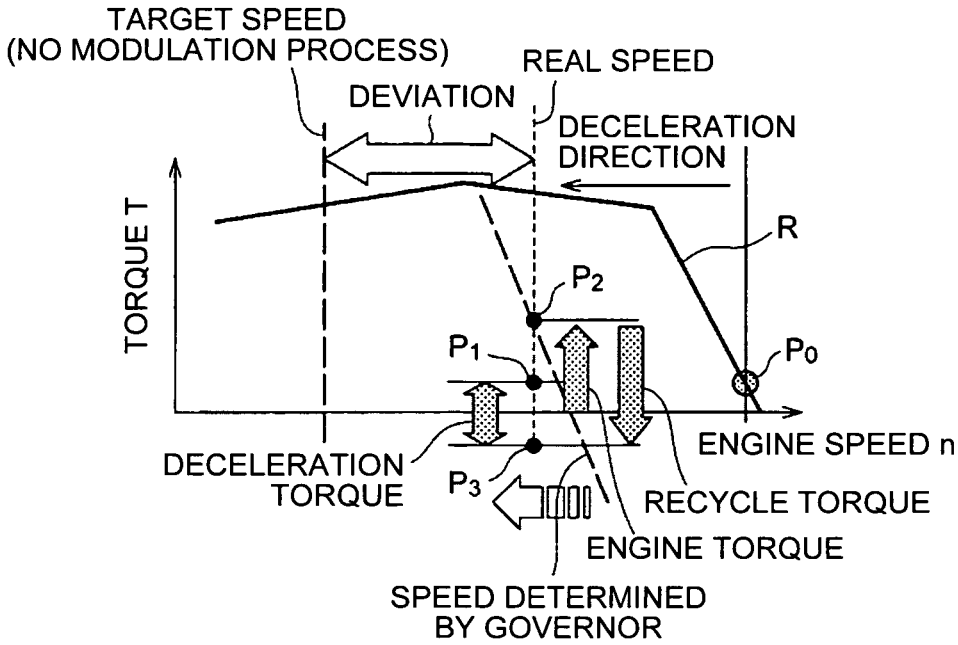
FIG. 14 is a graph illustrating an operation on which a modulation process is not performed when an engine is decelerated.
Figure 15:
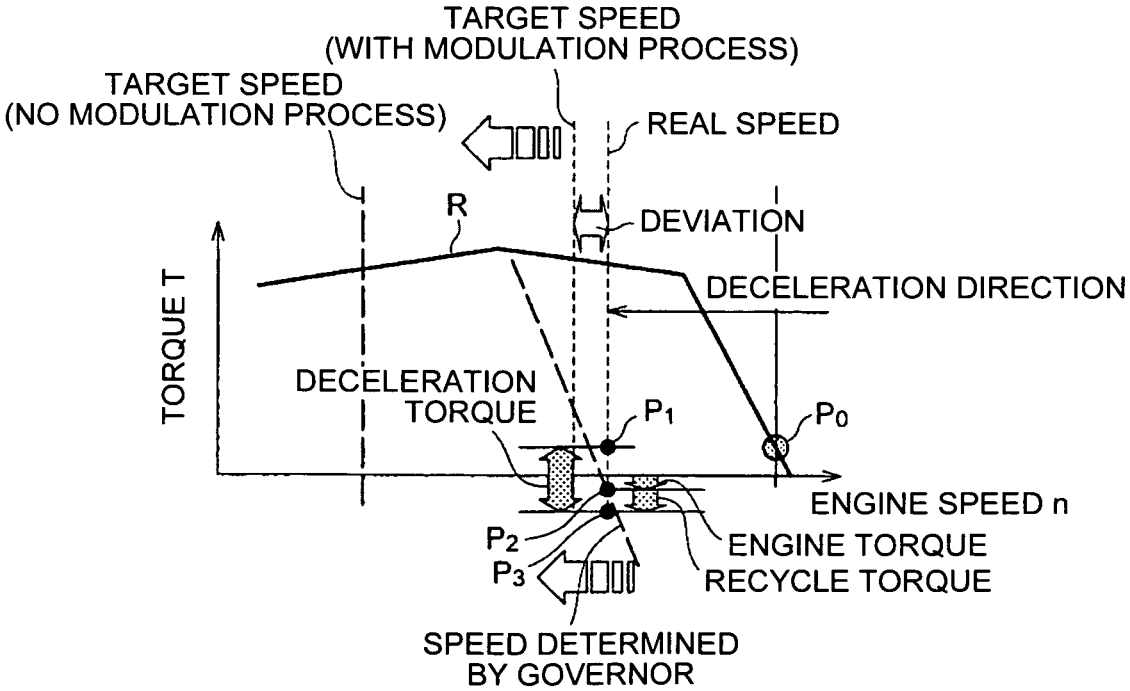
FIG. 15 is a graph illustrating an operation on which a modulation process is performed when an engine is decelerated.

FIG. 12 is a graph illustrating a move of a governor on which the modulation process is not performed when an engine is accelerated. FIG. 13 is a graph illustrating a move of a governor on which the modulation process is performed when an engine is accelerated. FIG. 14 is a graph illustrating a move of a governor on which the modulation process is not performed when an engine is decelerated. FIG. 15 is a graph illustrating a move of a governor on which the modulation process is performed when an engine is decelerated. When a mechanism governor is used as a governor, a speed determined by the governor may be less than a real engine speed.

Referring to FIGS. 12 and 13, when a load of the hydraulic pump 3 is great, the engine 2 is accelerated from a low rotation matching point P0 to a high rotation side. In FIGS. 12 and 13, P2 corresponds to an engine torque. The sum of an assist torque and the engine torque is a total torque P3 of the engine 2 and the generator motor 11. P1 corresponds to a pump absorption torque, and the sum of the pump absorption torque and an acceleration torque corresponds to the total torque P3.

Referring to FIG. 12, when the modulation process is not performed, an assist torque corresponding to a deviation of an engine target speed and an engine real speed is generated. When the deviation is great, corresponding to the great deviation, the assist torque is increased by the generator motor 11. Thus, the engine 2 is accelerated more rapidly than the governor is, so that a real speed is greater than a speed determined by the governor. when the engine 2 is rapidly accelerated, a fuel injection amount is decreased by adjusting the governor so as to decrease an engine torque. Accordingly, although the engine 2 is assisted by the generator motor 11, the engine 2 is in a friction state, so that the acceleration of the engine 2 is not increased. Thus, while a fuel injection amount and an engine torque are decreased, the engine 2 is in a loss state, and the engine 2 is accelerated, thus losing energy, and the engine 2 is not sufficiently accelerated.

Referring to FIG. 13, when the modulation process is performed, the modulation process is performed on an engine target speed, and a deviation between the engine target speed and the engine real speed is decreased, and thus, a small assist torque is generated at the generator motor 11. Accordingly, the governor is accelerated following the engine 2, and the speed determined by the governor is equal to the real speed. Thus, energy loss is reduced to sufficiently accelerate the engine 2.

Next, a case where the engine 2 is decelerated will now be described. Referring to FIGS. 14 and 15, when a load of the hydraulic pump 3 is great, the engine 2 is decelerated from a high rotation matching point P0 to a low rotation side.

In FIGS. 14 and 15, P2 corresponds to an engine torque. The sum of a recycle torque and the engine torque is a total torque P3 of the assist 2 and the generator motor 11. P1 corresponds to a pump absorption torque, and the sum of the pump absorption torque and a deceleration torque corresponds to the total torque P3.

Referring to FIG. 14, when the modulation process is not performed, a recycle torque corresponding to a deviation of an engine target speed and an engine real speed is generated. When the deviation is great, corresponding to the great deviation, the assist torque is increased by the generator motor 11. Thus, the engine 2 is decelerated more rapidly than the governor is, so that a real speed is less than a speed determined by the governor. When the engine 2 is rapidly decelerated, a fuel injection amount is increased by operating the governor so as to increase an engine torque. Accordingly, the engine 2 increases torque, and electricity is generated at the generator motor 11 so as to decelerate the engine 2. As a result, the engine 2 increase torque, and increased engine energy is recycled by the generator motor 11, so that the engine 2 is decelerated, thus generating useless electricity and wasting energy.

Referring to FIG. 15, when the modulation process is performed, the modulation process is performed on an engine target speed, and a deviation of the engine target speed and the engine real speed is decreased, and thus, a small assist torque is generated at the generator motor 11. Accordingly, the governor is accelerated more rapidly than the engine 2, and the speed determined by the governor is equal to the real speed. Thus, the torque of the engine 2 is minus, and velocity energy of the engine 2 is recycled by the generator motor 11, so that the engine 2 is decelerated, thus preventing energy loss and decelerating the engine 2 with improved efficiency.

At the generator motor torque calculation unit 68, an target torque Tgen_com corresponding to the current voltage BATT_volt is calculated based on the current voltage BATT_volt of the storage battery 12 detected at the voltage sensor 15.

At the memory device, a functional relation 68*a* having a hysteresis that the target torque Tgen_com is decreased according to the increase of the voltage BATT_volt of the storage battery 12 and the target torque Tgen_com is increased according to the decrease of the voltage BATT_volt of the storage battery 12 is memorized in a data table manner. The functional relation 68*a* adjusts a generation amount of the generator motor 11, and is set to maintain a voltage value of the storage battery 12 in a predetermined range.

At the generator motor torque calculation unit 68, the target torque Tgen_com corresponding to the current voltage BATT_volt of the storage battery 12 is output with respect to the functional relation 68*a*.

At the assist flag determination unit 95, when the content of the assist flag assist_flag is T, the generator motor command value switch unit 87 is switched to the modulation process unit 97, and the target speed Ngen_com output at the modulation process unit 97 as the generator motor command value GEN_com is output to the inverter 13 to control the speed of the generator motor 11, and the generator motor 11 performs generation action or electric motor action.

In addition, at the assist flag determination unit 95, when the content of the assist flag assist_flag is F, the generator motor command value switch unit 87 is switched to the generator motor torque calculation unit 68, and the target torque Tgen_com output at the generator motor torque calculation unit 68 as the generator motor command value GEN_com is output to the inverter 13 to control the torque of the generator motor 11, and the generator motor 11 performs generation action.

At a pump absorption torque command value switch unit 88, according to whether a determined result of the assist flag determination unit 95 is T is or not (F), a content of a pump target absorption torque T provided to a control current calculation unit 67 is switched to a first pump target absorption torque Tp_com1 or a second pump target absorption torque Tp_com2.

The first pump target absorption torque Tp_com1 is calculated at a first pump target absorption torque calculation unit 66 (the same configuration of a first pump target absorption torque calculation unit 66 as illustrated in FIG. 2).

Figure 18:
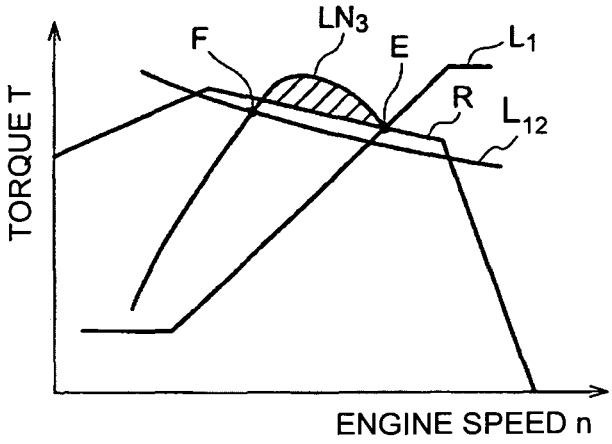
FIG. 18 illustrates a torque graph according to another embodiment of the invention.

That is, the first pump target absorption torque Tp_com1 is provided as a torque value on a first target torque line L1 in a torque graph of FIG. 18. The first target torque line L1 is set as an target torque line where the target absorption torque Tp_com1 of the hydraulic pump 3 is decreased as the engine target speed n is decreased.

The second pump target absorption torque Tp_com2 is calculated at a second pump target absorption torque calculation unit 85. That is, the second pump target absorption torque Tp_com2 is provided as a torque value on a second target torque line L12 where a pump target absorption torque is increased in a low rotation region with respect to the first target torque line L1 in the torque graph of FIG. 18.

At the first pump target absorption torque calculation unit 66, the first pump target absorption torque Tp_com1 of the hydraulic pump 3 corresponding to the engine target speed ncom is calculated.

At the memory device, a functional relation 66*a* that the first pump target absorption torque Tp_com1 of the hydraulic pump 3 is increased according to the increase of the engine target speed ncom is memorized in a data table manner. The function 66*a* is a curve corresponding to a first target torque line L1 on a torque graph of FIG. 16.

Figure 16:
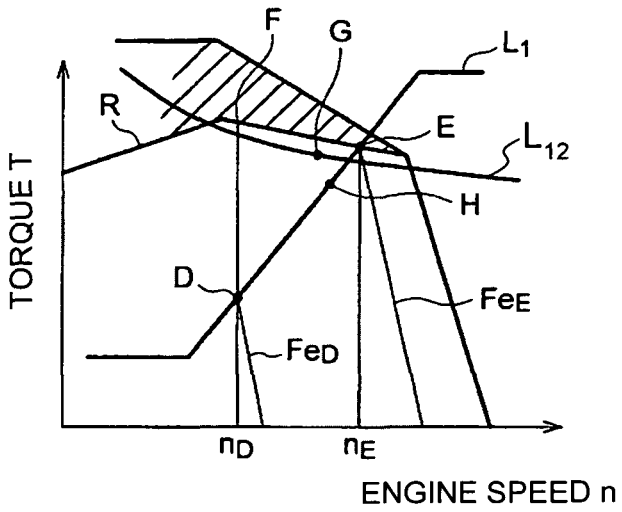
FIG. 16 illustrates a torque graph according to an embodiment of the invention.

FIG. 16 illustrates a torque graph of the engine 2 with a horizontal axis being an engine speed n (rpm; rev/min) and a vertical axis being torque T (Nm). The function 66*a* corresponds to the target torque line L1 on the torque graph of FIG. 16

At the first pump target absorption torque calculation unit 66, the first pump target absorption torque Tp_com1 corresponding to the current engine target speed ncom is calculated according to the functional relation 66*a*.

At the second pump target absorption torque calculation unit 85, the second pump target absorption torque Tp_com2 of the hydraulic pump 3 corresponding to the real speed GEN_spd of the generator motor 11 is calculated.

At the memory device, a functional relation 85*a* that that the second pump target absorption torque Tp_com2 of the hydraulic pump 3 is varied according to the real speed GEN_spd of the generator motor 11 is memorized in a data table manner. The function 85*a* is a curve corresponding to the second target torque line L12 on the torque graph of FIG. 16, and has a characteristic that a pump target absorption torque is increased in a low rotation region with respect to the first target torque line L1. For example, the second target torque line L12 is a curve corresponding to an iso horsepower line, and adopts a characteristic that a torque is decreased according to the increase of an engine speed.

At the second pump target absorption torque calculation unit 85, the second pump target absorption torque Tp_com2 corresponding to the current real speed GEN_spd of the generator motor 11 is calculated according to the functional relation 85*a*.

At the assist flag determination unit 95, when the content of the assist flag assist_flag is T, the pump absorption torque command value switch unit 88 is switched to the second pump target absorption torque calculation unit 85, and the second pump target absorption torque Tp_com2 output at the second pump target absorption torque calculation unit 85 is output as a pump target absorption torque Tp_com to a filter process unit 89 at the rear end.

In addition, at the assist flag determination unit 95, when the content of the assist flag assist_flag is F, the pump absorption torque command value switch unit 88 is switched to the first pump target absorption torque calculation unit 66, and the first pump target absorption torque Tp_com1 output at the first pump target absorption torque calculation unit 66 is output as the pump target absorption torque Tp_com to a filter process unit 89 at the rear end.

As described above, at the pump absorption torque command value switch unit 88, the target absorption torques Tp_com1 and Tp_com2 of the hydraulic pump 3, that is, the target torque lines L1 and L12 of FIG. 16 are selectively switched.

At the filter process unit 89, when the target torque lines L1 and L12 are selectively switched, a filter process is performed to slowly switch from the pump target absorption torque (the second pump target absorption torque Tp_com2) on the target torque line (for example, the second target torque line L12) before the switching to the pump target absorption torque (the first pump target absorption torque Tp_com1) on the target torque line (for example, the first target torque line L1) after the switching.

That is, when the target torque lines L1 and L12 are selectively switched, the filter process unit 89 outputs the target torque value Tp_com, on which the filter process is performed, according to a characteristic 89*a*. When the target torque lines L1 and L12 are selectively switched, instead of performing an output operation as it is from the pump target absorption torque (the second pump target absorption torque Tp_com2) on the target torque line (for example, the second target torque line L12) before the switching to the pump target absorption torque (the first pump target absorption torque Tp_com1) on the target torque line (for example, the first target torque line L1) after the switching, the switching is slowly performed over time t from the pump target absorption torque (the second pump target absorption torque Tp_com2) on the target torque line (the second target torque line L12) before the switching to the pump target absorption torque (the first pump target absorption torque Tp_com1) on the target torque line (the first target torque line L1) after the switching.

Referring to FIG. 16, the switching is slowly performed over time from the second pump target absorption torque Tp_com2 at a point G on the second target torque line L12 to the first pump target absorption torque Tp_com1 at a point H on the first target torque line L1.

Accordingly, shock of an operator or a body due to a quick torque variation is controlled, and discomfort in operation sense is removed.

The filter process may be performed when a determined result of the assist flag determination unit 95 is switched both from T to F and from F to T. Alternatively, the filter process may be performed when a determined result of the assist flag determination unit 95 is switched one of both from T to F and from F to T.

Particularly, in the case where a determined result of the assist flag determination unit 95 is switched from T to F and the switching is performed from the second target torque line L12 to the first target torque line L1, when the filter process is not performed, torque is quickly decreased and discomfort in operation sense is increased. Thus, when a determined result is switched from T to F and the switching is performed from the second target torque line L12 to the first target torque line L1, the filter process may be performed.

The pump target absorption torque Tp_com output at the filter process unit 89 is provided to the control current calculation unit 67. At the control current calculation unit 67, a control current pc_epc corresponding to the pump target absorption torque Tp_com is calculated.

At the memory device, a functional relation 67*a* that the control current pc_epc is increased according to the increase of the pump target absorption torque Tp_com is memorized in a data table manner.

At the control current calculation unit 67, the control current pc_epc corresponding to the current pump target absorption torque Tp_com is calculated according to the functional relation 67*a*.

The control current pc_epc is output from the controller 6 to the pump control valve 5 to adjust the pump control valve 5 through a servo piston. The pump control valve 5 PC-controls the tilt angle of the inclined plate of the hydraulic pump 3 such that the product of the discharge pressure PRp ($kg/cm^2$) of the hydraulic pump 3 and the capacity q (cc/rev) of the hydraulic pump 3 is not greater than the pump target absorption torque Tp_com corresponding to the control current pc_epc.

According to the current embodiment, as illustrated in FIG. 16, the first target torque line L1 where the target absorption torque of the hydraulic pump 3 is decreased according to the decrease of the engine target speed is set. In addition, the second target torque line L12 where the pump absorption torque is increased in the low rotation region with respect to the first target torque line L1 is set.

In addition, the engine speed is controlled to be equal to the engine target speed. For example, with respect to operation amounts of the operation levers 41, 42, 43, and 44, when it is determined that the load of the hydraulic pump 3 is small, an engine target speed is set to a small speed nD. With respect to the operation amounts of the operation levers 41, 42, 43, and 44, when it is determined that the load of the hydraulic pump 3 is great, an engine target speed is set to a large speed nE.

In addition, it is determined whether the deviation between the engine target speed and the real speed of the engine 2 is equal to or greater than a predetermined threshold, or not, that is, whether the generator motor 11 assists the engine 2 or not.

When the deviation between the engine target speed and the real speed of the engine 2 is not equal to or not greater than a predetermined threshold, the first target torque line L1 is selected, and the capacity of the hydraulic pump 3 is controlled to obtain the pump absorption torque on the first target torque line L1 corresponding to the engine target speed.

Thus, when the engine target speed is set to the low rotation nD, the governor is disposed on a regulation line FeD corresponding to the engine target speed nD, so that an fuel injection amount is increased or decreased such that the engine 2 and the hydraulic pump absorption torque are in equilibrium with a point D crossing the first target torque line L1 being as an upper limit torque value. Statically, matching is achieved at the point D on the first target torque line L1.

In addition, when the engine target speed is set to the high rotation nE, the governor is disposed on a regulation line FeE corresponding to the engine target speed nE, so that a fuel injection amount is increased or decreased such that the engine 2 and the hydraulic pump absorption torque are in equilibrium with a point E crossing the first target torque line L1 being as an upper limit torque value. Statically, matching is achieved at the point E on the first target torque line L1.

Thus, when the assist operation is not performed by the generator motor 11, since the engine 2 is controlled along the target torque line L1 in a same manner as the comparative example, fuel efficiency, pump efficiency, and engine efficiency are improved, and noises are reduced, and engine stop is prevented.

When the deviation between the engine target speed and the real speed of the engine 2 is equal to or greater than a predetermined threshold, the generator motor 11 performs electric motor action. Accordingly, the torque portion as illustrated in FIG. 16 is added to the engine torque.

In addition, when being equal to or greater than the predetermined threshold, the second target torque line L12 is selected, and the capacity of the hydraulic pump 3 is controlled to obtain the pump target absorption torque on the second target torque line L12 corresponding to the engine speed.

For example, when the operation lever 41 is tilted from the neutral position to start an excavation work, it may be necessary that the engine speed is increased from a low speed to the matching point E with a high load and a high speed.

Figure 17:
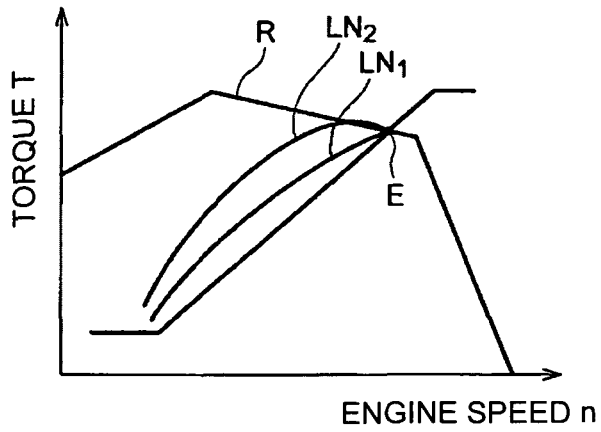
FIG. 17 illustrates a torque graph according to another embodiment of the invention.

When the assist control operation is not performed, the engine 2 is accelerated along a path LN1 of FIG. 17. At an initial stage of an excavation work, it may be necessary that a work device is operated with an engine speed being increased. When a move to the second target torque line L12 or the assist operation according to the generator motor 2 are not present, at an initial stage of the increase in the engine speed, the absorption torque of the hydraulic pump 3 is decreased. Thus, move start of a work device is delayed with respect to a move of the operation lever, and work efficiency is decreased, and discomfort of an operator is increased.

In the current embodiment, since the assist operation through the generator motor 11 is added, the engine 2 is accelerated along a path LN2. In this case, since the assist operation through the generator motor 2 is performed, the absorption torque of the hydraulic pump 3 is increased at the initial stage of the increase in the engine speed. Thus, move start of a work device becomes fast with respect to a move of the operation lever, and work efficiency is increased, and discomfort of an operator is reduced.

In the current embodiment, the engine 2 is accelerated along a path LN3 of FIG. 18. According to the current embodiment, the engine 2 reaches a point E through a point F on a second target torque line L12 at a low speed. That is, just after the operation lever 41 is tilted, since the hydraulic pump absorption torque instantly reaches a point F at a high torque, move start of a work device becomes fast relative to the operation lever. Thus, while the engine 2 is accelerated, the work device is not slow relative to the operation lever, and is instantly moved with a great force. Accordingly, work efficiency is improved, and discomfort in operation sense is decreased. In addition, in the state where the assist operation through the generator motor 11 is not performed (a hatching area of FIG. 18 is removed), when a move is performed along the second target torque line L12, overload may be applied to the engine 2. In the current embodiment, the move performed along the second target torque line L12 is guaranteed based on the assist operation through the generator motor 11.

Particularly, since an engine speed is decreased in the relief operation at a high load pressure state, the deviation between an engine target speed and a real engine speed is increased, and just after the relief operation, the engine target speed is increased, but the real engine speed is decreased, and it takes time for the real engine speed to move to the engine target speed. In the current embodiment, when this large deviation occurs, the assist control is performed. Thus, the real engine speed is rapidly returned to the engine target speed, thus performing a work without feeling work amount reduction.

In the current embodiment, engine efficiency and pump efficiency are improved, and a work device having improved response performance according to an operation's selection can be operated.

Figure 19:
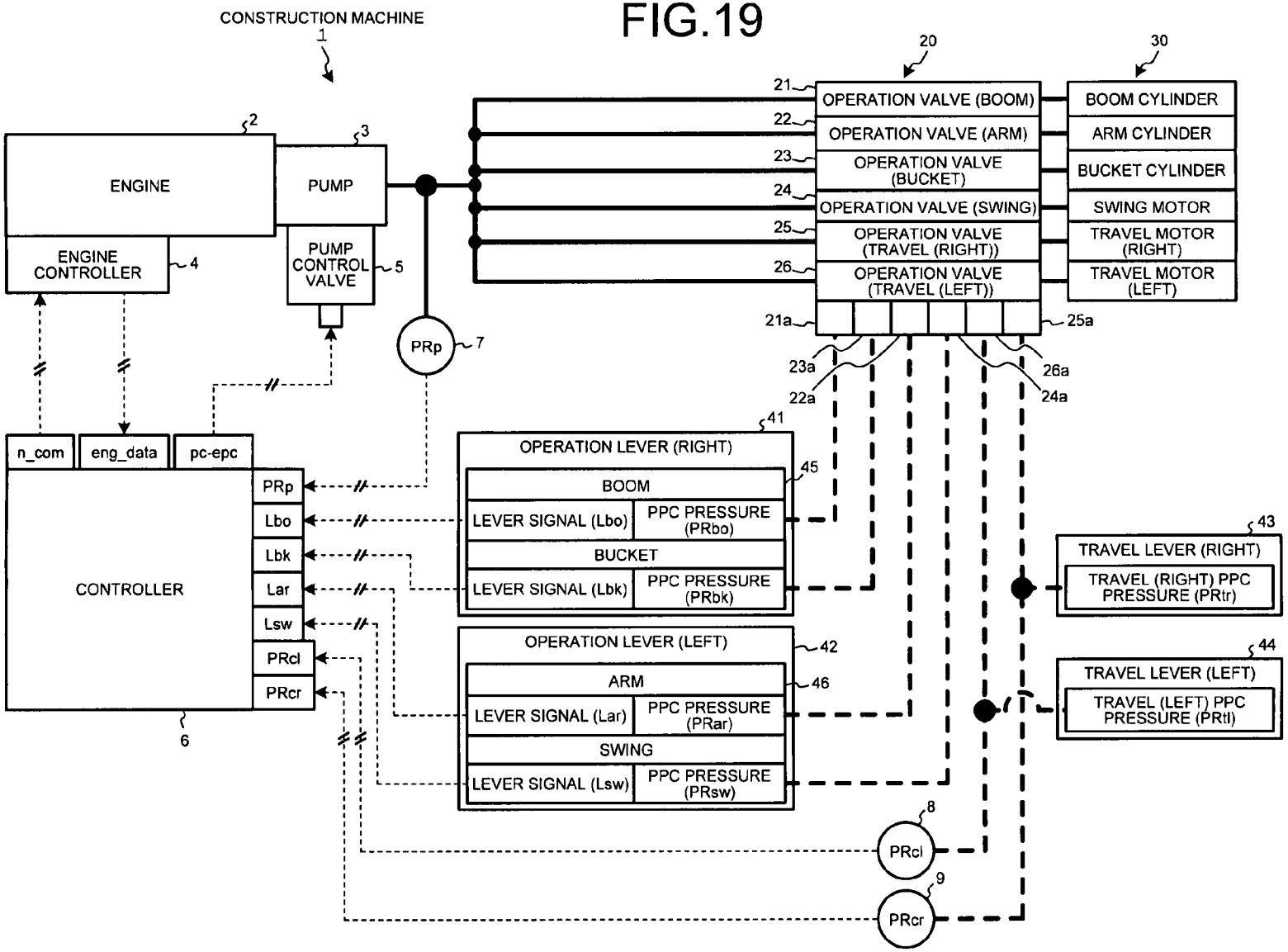
FIG. 19 is a block diagram illustrating a schematic configuration of a construction machine according to another modified embodiment of the invention.
Figure 20:
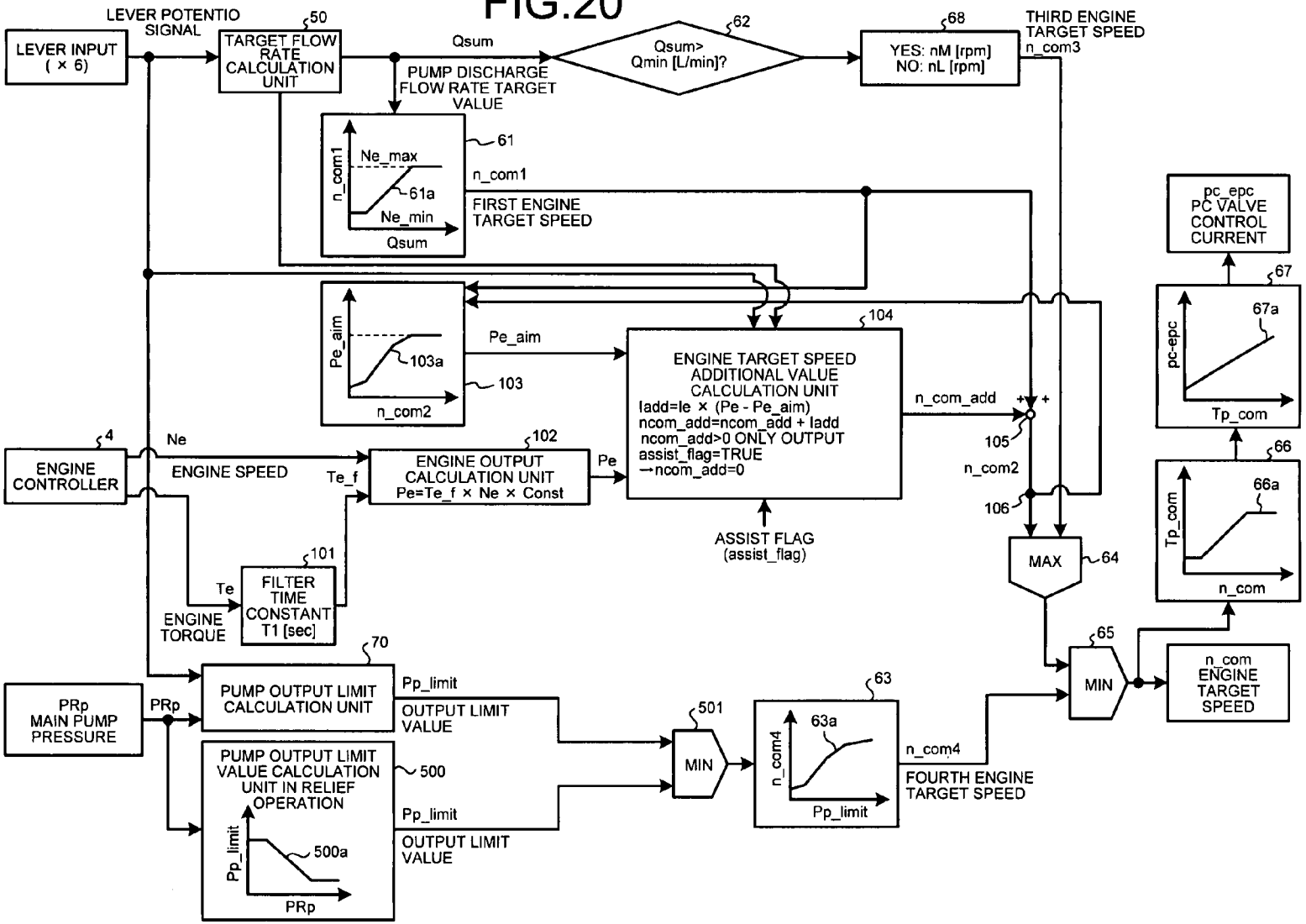
FIG. 20 is a flow chart illustrating a control flow of a controller of FIG. 19.
Figure 21:
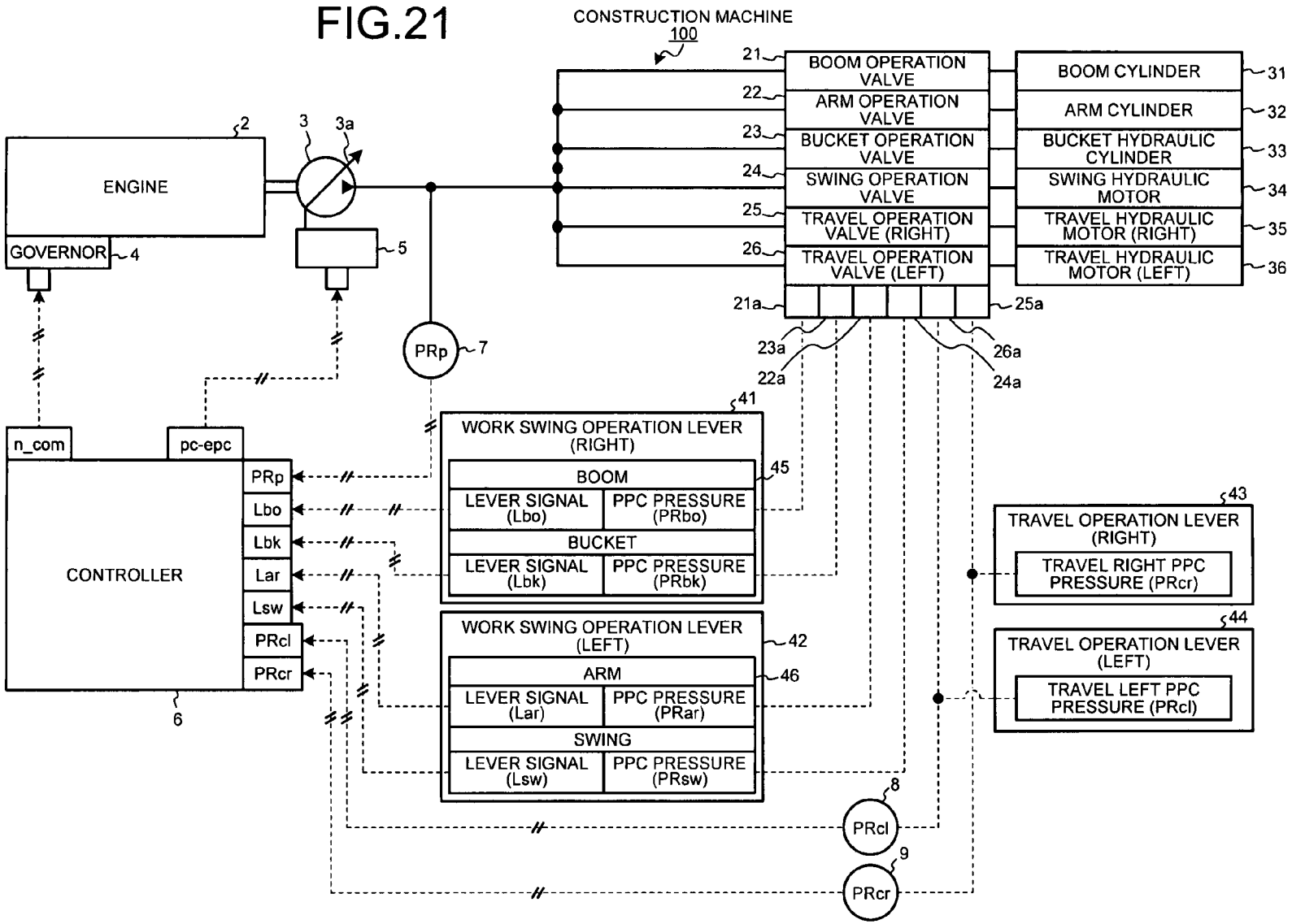
FIG. 21 is a block diagram illustrating a schematic configuration of a conventional construction machine.

In addition, the current embodiment can be applied to a construction machine having no assist action without a generator motor, and a storage battery, like the construction machine illustrated in FIG. 21. FIG. 19 is a block diagram illustrating a configuration of a construction machine according to an embodiment of the invention. FIG. 20 is a flow chart of a controller of FIG. 19. The construction machine has the same control flow as that of the controller illustrated in FIG. 2 except for control operations performed without a generator motor and a storage battery.

In addition, at the construction machine, the pump absorption torque calculation unit 66 calculates the target absorption torque Tpcom of the hydraulic pump 3 corresponding to the engine target speed ncom.

At the memory device in the controller 6, the functional relation 66*a* that the target absorption torque Tpcom of the hydraulic pump 3 is increased according to the increase of the engine target speed ncom is memorized in a data table manner. The functional 66*a* is a curve corresponding to the target torque line L1 on the torque graph illustrated in FIG. 7.

FIG. 7 illustrates the torque graph of the engine 2 in a same manner as that of FIG. 22, in which the horizontal axis denotes the engine speed n (rpm; rev/min) and the vertical axis denotes the torque T (Nm). The functional 66*a* is a curve corresponding to the target torque line L1 on the torque graph illustrated in FIG. 7.

At the pump absorption torque calculation unit 66, the target absorption torque Tpcom of the hydraulic pump 3 corresponding to the current engine target speed ncom is calculated according to the function 66*a*.

At the control current calculation unit 67, the control current pc_epc corresponding to the pump target absorption torque Tpcom is calculated.

At the memory device in the controller 6, the functional relation 67*a* that the control current pc_epc is increased according to the increase of the pump target absorption torque Tpcom is memorized in a data table manner.

At the pump absorption torque calculation unit 66, the control current pc_epc corresponding to the target pump absorption torque Tpcom is calculated according to the functional relation 67*a*.

The control current pc_epc is output from the controller 6 to the pump control valve 5 to adjust the pump control valve 5 through a servo piston. The pump control valve 5 PC-controls the tilt angle of the inclined plate of the hydraulic pump 3 such that the product of the discharge pressure PRp ($kg/cm^2$) of the hydraulic pump 3 and the capacity q (cc/rev) of the hydraulic pump 3 is not greater than the pump target absorption torque Tpcom corresponding to the control current pc_epc.

In addition, the current embodiment may be applied to a construction machine provided with an electric swing system configured to rotate the upper swing body of the construction machine through electric actuator.

In addition, a determination whether the operation levers 41, 42, 43, and 44 are switched from non-operation states to operation states is not limited to the aforementioned embodiment. Thus, when an operation amount of the operation levers 41, 42, 43, and 44 is greater than a predetermined threshold, it may be considered that the operation levers 41, 42, 43, and 44 are switched from the non-operation states to the operation states.

The invention claimed is:

1. An engine control apparatus comprising:

a hydraulic pump driven by an engine;

a hydraulic actuator to which pressure oil discharged from the hydraulic pump is supplied;

an operation unit configured to operate the hydraulic actuator;

a first target speed set unit configured to set a first target speed of the engine;

a second target speed calculation unit configured to calculate a second target speed limiting a maximum target speed of the engine according to increase of a load pressure of the hydraulic pump; and a speed control unit configured to control an engine speed such that the engine speed is equal to the lower one of the first target speed and the second target speed.

2. The engine control apparatus according to claim 1, wherein the first target speed set unit calculates the first target speed of the engine according to an operation amount of the operation unit.

3. The engine control apparatus according to claim 1, further comprising:

a horsepower limit value calculation unit configured to calculate a pump horsepower limit value such that absorbable horsepower of the hydraulic pump is decreased according to the increase of the load pressure of the hydraulic pump, wherein the second target speed calculation unit calculates the second target speed to limit the maximum target speed of the engine according to the horsepower limit value of the hydraulic pump calculated by the horsepower limit value calculation unit.

4. The engine control apparatus according to claim 1, further comprising:

a horsepower limit value calculation unit configured to calculate a pump horsepower limit value such that absorbable horsepower of the hydraulic pump is decreased when the load pressure of the hydraulic pump is greater than a value less than a value preset with respect to a relief pressure, wherein the second target speed calculation unit calculates the second target speed to limit the maximum target speed of the engine according to the horsepower limit value of the hydraulic pump calculated by the horsepower limit value calculation unit.

5. The engine control apparatus according to claim 3, further comprising:

a maximum absorption torque control unit configured to control an absorbable maximum torque of the hydraulic pump according to the horsepower limit value of the hydraulic pump calculated by the horsepower limit value calculation unit.

6. The engine control apparatus according to claim 1, further comprising:

a generator motor connected to an output shaft of the engine;

a storage battery configured to store electric power which the generator motor generates, and to supply electric power to the generator motor; and a control unit, wherein when the load pressure of the hydraulic pump is quickly switched from a high state to a low state, until a real speed of the engine is increased to be equal to or greater than a value preset with respect to the target speed, the control unit uses an engine torque assist action of the generator motor to control the engine speed to be equal to the target speed.

7. The engine control apparatus according to claim 1, further comprising:

a generator motor connected to an output shaft of the engine;

a storage battery configured to store electric power the generator motor generates, and to supply electric power to the generator motor; and a control unit, wherein, by increase of the second target speed according to a case where the load pressure of the hydraulic pump is decreased from a high state to a low state, when a real speed of the engine is less than a preset value and the target speed, until the real speed is increased to be equal to or greater than a value less than the preset value and the target speed, the control unit uses an engine torque assist operation of the generator motor to control the engine speed to be equal to the target speed.

8. The engine control apparatus according to claim 4, further comprising:

a maximum absorption torque control unit configured to control an absorbable maximum torque of the hydraulic pump according to the horsepower limit value of the hydraulic pump calculated by the horsepower limit value calculation unit.

* * * * *